US012782020B1

(12) United States Patent
Thrift et al.

(10) Patent No.: US 12,782,020 B1
(45) Date of Patent: Nov. 3, 2026

(54) DETERMINING LOSS OF CHARGE FOR CLIMATE CONTROL SYSTEM

(71) Applicant: Trane International Inc., Davidson, NC (US)

(72) Inventors: Jonathan E. Thrift, Jacksonville, TX (US); Ulysses Grundler, Little Elm, TX (US); Shriraj Nair, Bangalore (IN); Aditya Shrivastava, Bangalore (IN); Suresh Nukala, Bangalore (IN); Arulkumar Kaliyaperumal, Mayiladuthurai (IN); Wilson Samuel Jesudason Lawrence, Bangalore (IN); Gautam Peri, Simhachalam (IN)

(73) Assignee: Trane International Inc., Davidson, NC (US)

( * ) Notice: Subject to any disclaimer, the term of this patent is extended or adjusted under 35 U.S.C. 154(b) by 789 days.

(21) Appl. No.: 18/057,613

(22) Filed: Nov. 21, 2022

(51) Int. Cl.
*F25B 49/02* (2006.01)

(52) U.S. Cl.
CPC ..... *F25B 49/02* (2013.01); *F25B 2500/222* (2013.01); *F25B 2700/171* (2013.01); *F25B 2700/19* (2013.01); *F25B 2700/2103* (2013.01)

(58) Field of Classification Search
CPC .... F25B 13/00; F25B 2500/222; F25B 49/02; F25B 49/022; F25B 2700/171; F25B 2700/19; F25B 2700/2103; F24F 11/38; F24F 11/32; F24F 11/36; F24F 11/86; F24F 2110/10; F24F 2110/30; F25D 2500/04; F25D 2500/00; F28F 2265/16; F28F 2265/00; G05B 15/02; G05B 23/0221; G05B 23/0218
See application file for complete search history.

(56) References Cited

U.S. PATENT DOCUMENTS

| | | | | |
|---|---|---|---|---|
| 5,335,513 | A | 8/1994 | Campbell et al. | |
| 8,590,325 | B2 | 11/2013 | Pham | |
| 9,168,315 | B1 * | 10/2015 | Scaringe | F24F 11/30 |
| 10,352,602 | B2 | 7/2019 | Kates | |
| 10,670,353 | B2 | 6/2020 | Victor et al. | |
| 10,782,040 | B2 | 9/2020 | Wacker | |
| 11,193,685 | B2 | 12/2021 | Brahme et al. | |
| 11,274,866 | B2 | 3/2022 | Yamada et al. | |
| 2007/0163276 | A1 * | 7/2007 | Braun | F25B 49/005 62/149 |

(Continued)

*Primary Examiner* — Catherine T. Rastovski
*Assistant Examiner* — Brian Butler Geiss
(74) *Attorney, Agent, or Firm* — Womble Bond Dickinson (US) LLP

(57) ABSTRACT

Examples of the present disclosure relate to systems and methods for monitoring the refrigerant change level of a climate control systems. Some examples include monitoring a subcooling performance of the climate control system. This may include determining the subcooling values for the climate control system over time. These subcooling values may be culled into a relevant set of subcooling values based on a plurality of parameters. The monitoring may further include determining a representative subcooling metric for the climate control system from the relevant set of subcooling values. This relevant subcooling metric may be compared to a target subcooling metric, and based on this comparison a signal may be issued. This signal may be indicative of a level of refrigerant charge within the climate control system.

36 Claims, 10 Drawing Sheets

(56) References Cited

U.S. PATENT DOCUMENTS

| | | | |
|---|---|---|---|
| 2014/0123685 | A1 | 5/2014 | Kim et al. |
| 2021/0180817 | A1 | 6/2021 | Brahme et al. |
| 2022/0082323 | A1 | 3/2022 | Poulsen |

* cited by examiner

DETERMINING LOSS OF CHARGE FOR CLIMATE CONTROL SYSTEM

TECHNOLOGICAL FIELD

The present disclosure relates generally to improved systems and methods for monitoring and diagnosing a loss of refrigerant charge within a climate control system.

BACKGROUND

Climate control systems may generally be used in residential and/or commercial areas for heating and/or cooling to create comfortable temperatures inside those areas. As part of these systems, refrigerant is used to absorb heat from conditioned air to provide conditioned air to a conditioned space after running through various components of the climate control systems.

These climate control systems typically need the appropriate level of refrigerant charge to transport this thermal energy through the various components. If a system is improperly charged the capacity may decrease and/or the efficiency may suffer. Further, while this refrigerant provides various benefits, e.g., allowing for the exchange of thermal energy between the various components within the system, it can also be harmful if not appropriately contained and accounted for. The potential harms vary based on the type of refrigerant utilized in the climate control system, however, in general a refrigerant leak could be hazardous to property and/or occupants.

Existing leak detection concepts struggle to monitor the existing refrigerant charge, particularly during operation. Various systems may include leak sensors and other techniques. These systems, however, may prove costly and/or only detect refrigerant leaks once a high level of refrigerant fluid has been discharged. Further, these systems typically are directed only to monitoring leaks for safety or regulatory purposes and fail to monitor the charge level of refrigerant in terms of system performance.

Therefore, there exists a need for an improved monitoring system and method for estimating the charge level of refrigerant within a climate control system.

BRIEF SUMMARY

Example implementations of the present disclosure relate to a system and method for monitoring the refrigerant charge in a climate control system. In general, the examples disclosed herein focus on monitoring the subcooling performance of a climate control system. By tracking this subcooling performance over time, which typically includes determining the subcooling values for the climate control system, the system and methods disclosed herein may track the overall level of refrigerant charge. As a result, these systems and methods may determine whether the climate control system has lost refrigerant charge, and potentially determine whether a refrigerant leak has occurred.

As described more fully below, these systems and methods may identify a relevant set of subcooling values. This relevant set may be determined using multiple different parameters, which in some examples are useful to identify subcooling values that are representative of the performance of the overall climate control system. The process may also use the identified set of subcooling values to determine a representative subcooling metric. This representative subcooling metric may be indicative of the overall performance of the climate control system with respect to subcooling.

The process may further include comparing the representative subcooling metric to a target subcooling metric. Based on this comparison, the process may determine whether the climate control system has an appropriate level refrigerant charge. The systems and methods described herein may further provide an alert based on this determination and/or take mitigating action.

The present disclosure thus includes, without limitation, the following examples.

Some example implementations include a method of monitoring refrigerant charge within a climate control system, the method comprising: monitoring a subcooling performance of the climate control system by determining subcooling values for the climate control system; identifying a relevant set of subcooling values based on a plurality of parameters; determining a representative subcooling metric for the climate control system from the relevant set of subcooling values; comparing the representative subcooling metric to a target subcooling metric; and providing a signal based on the comparison, the signal being indicative of a level of refrigerant charge within the climate control system.

Further example implementations may include an apparatus for monitoring a climate control system, the apparatus comprising: a memory configured to store computer-readable program code including a monitoring-related software application; and a processor configured to access the memory, and execute the computer-readable program code including the monitoring-related software application to cause the apparatus to at least: monitor a subcooling performance of the climate control system by determining subcooling values for the climate control system, identify a relevant set of subcooling values based on a plurality of parameters, determine a representative subcooling metric for the climate control system from the relevant set of subcooling values, compare the representative subcooling metric to a target subcooling metric, and provide a signal based on the comparison, the signal being indicative of a level of refrigerant charge within the climate control system.

These and other features, aspects, and advantages of the disclosure will be apparent from a reading of the following detailed description together with the accompanying drawings, which are briefly described below. The disclosure includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed disclosure, in any of its various aspects and embodiments, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure and should not be construed as limiting the disclosure.

Figure 5:
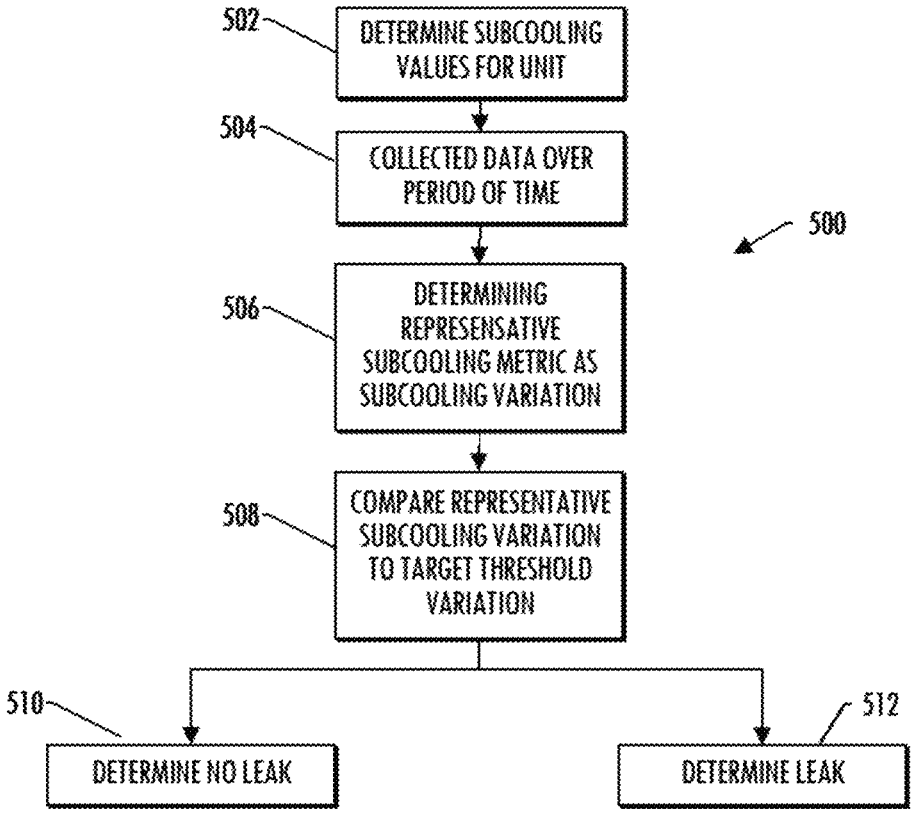
Figure 6:
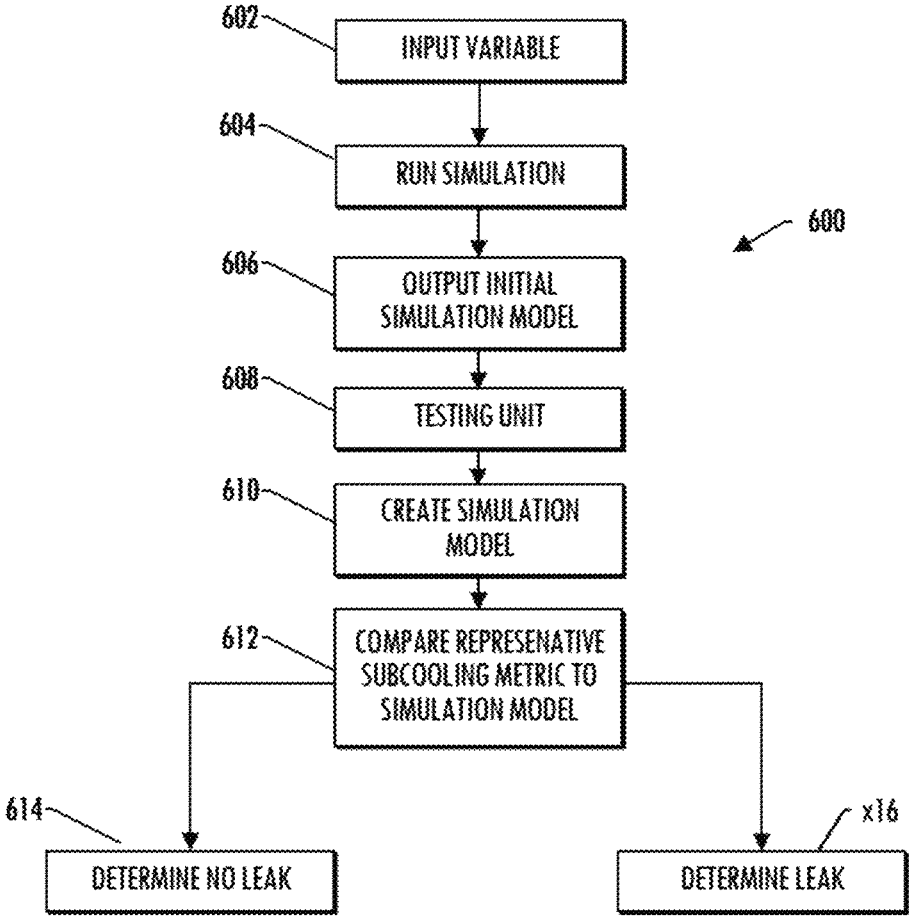
Figure 7A:
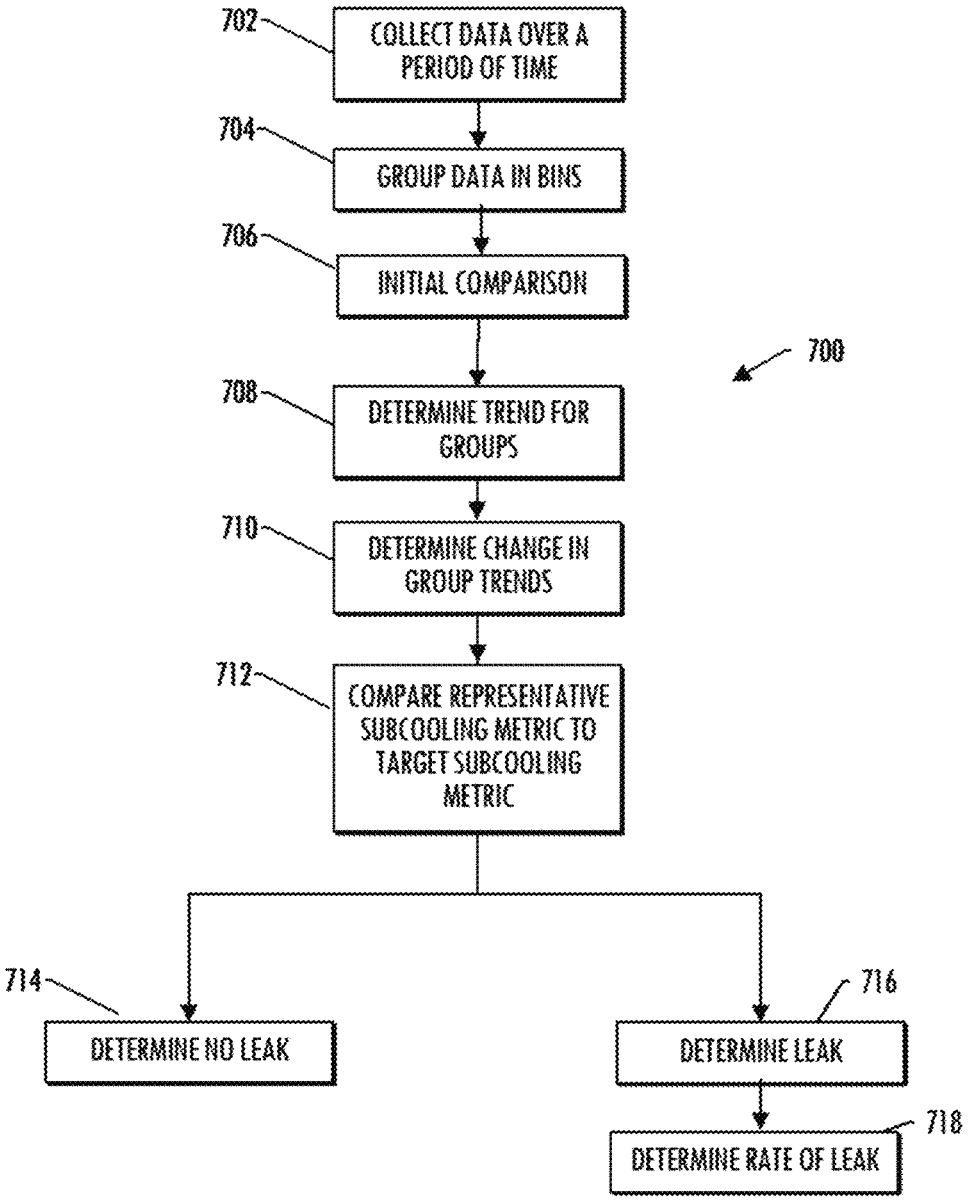
Figure 7B:
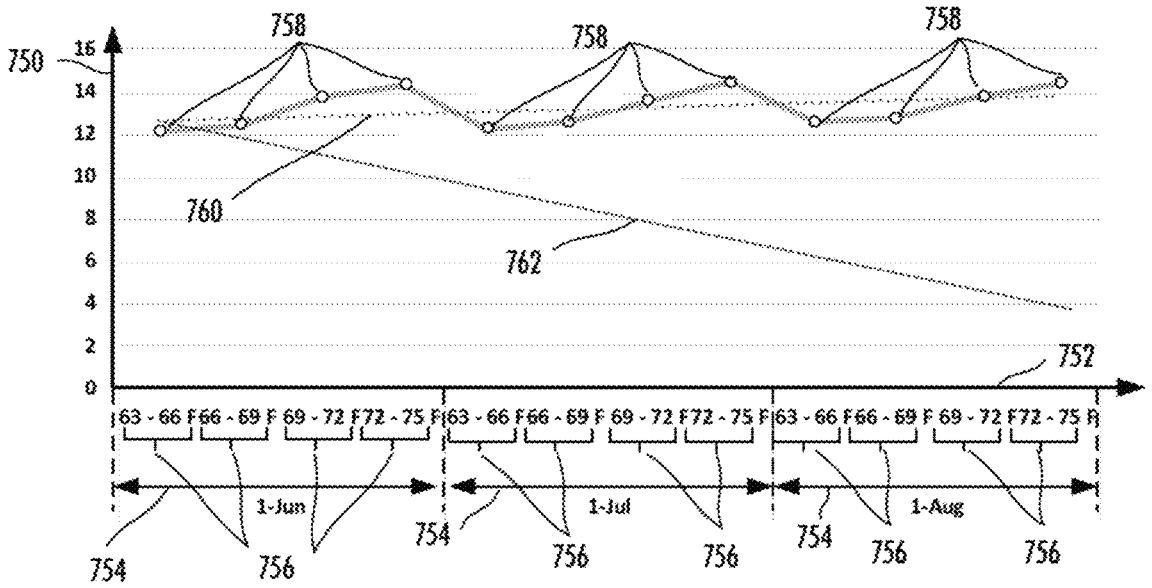
Figure 8:
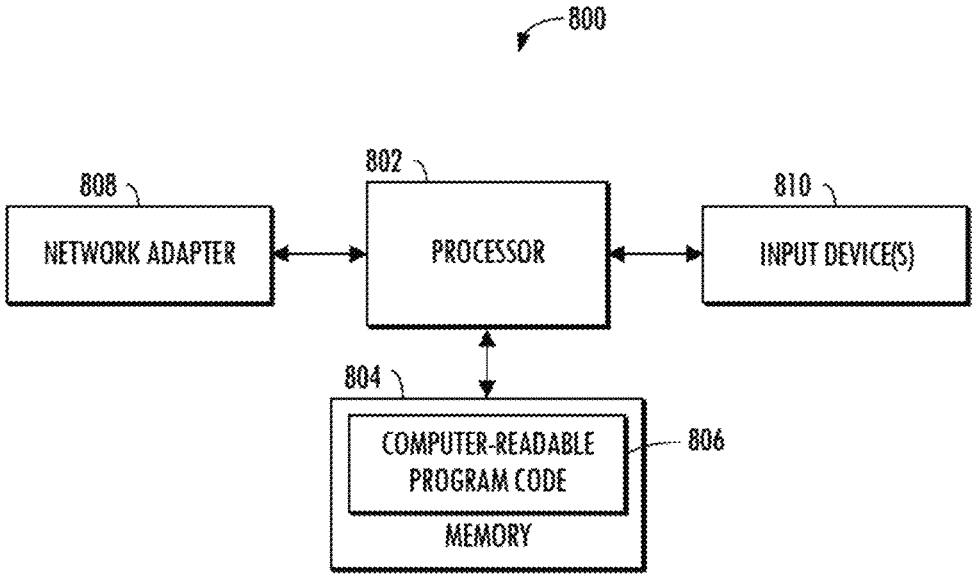

FIGS. 4A, 4B, 4C, 4D, 4E, and 4F illustrate comparisons of representative subcooling metrics to target subcooling metrics, according to some example implementations of the present disclosure;

FIG. 5 illustrates an example process for monitoring the refrigerant charge level for a climate control system, according to some example implementations of the present disclosure;

FIG. 6 illustrates an example process for monitoring the refrigerant charge level for a climate control system, according to some example implementations of the present disclosure;

FIG. 7A illustrates an example process for monitoring the refrigerant charge level for a climate control system, according to some example implementations of the present disclosure;

FIG. 7B illustrates a diagram of grouped subcooling values, according to some example implementations of the present disclosure; and FIG. 8 is an illustration of control circuitry, according to an example embodiment of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships, or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments of the described disclosure in the installed configuration (e.g., in an operational configuration). It is understood that such terms are not used in any absolute sense.

Example implementations of the present disclosure relate to systems and methods for monitoring the refrigerant charge in a climate control system. In general, the examples disclosed herein focus on monitoring the subcooling performance of a climate control system. By tracking this subcooling performance over time, which typically includes determining the subcooling values for the climate control system, the system and methods disclosed herein may track the overall level of refrigerant charge within the climate control system. As result, these systems and methods may determine whether the climate control system has lost refrigerant charge, and potentially determine whether a refrigerant leak has occurred.

As described more fully below, in some examples, the systems and methods may identify a relevant set of subcooling values as part of this process. This relevant set of subcooling values may be determined using multiple different parameters, which in some examples are useful to identify subcooling values that are representative of the performance for the overall climate control system. Further, the identified subcooling values, in some examples, may be easily compared to each other, which may allow for better tracking of the overall subcooling performance and/or performance deviations of the climate control system.

The process may also use the identified set of subcooling values to determine a representative subcooling metric. This representative subcooling metric may be indicative of the overall performance of the climate control system with respect to subcooling. Moreover, as discussed below, this representative subcooling metric may come in various forms, e.g., a set value, a trend line, a change in a trend line, etc. Indeed, the process for determining a representative metric may include multiple additional steps.

The process may further include comparing the representative subcooling metric to a target subcooling metric. In general, the target subcooling metric will be in the same or similar form as the representative subcooling metric, which will allow these two metrics to be compared. Based on this comparison, the process may determine that the climate control system has an inappropriate level refrigerant charge. In some examples, this comparison provides an indication that the climate control system is leaking refrigerant, and in further examples, the comparison provides an indication of the rate at which refrigerant is leaking. These processes are discussed in more detail below, however, first an overview of an example climate control system is discussed.

Figure 1:
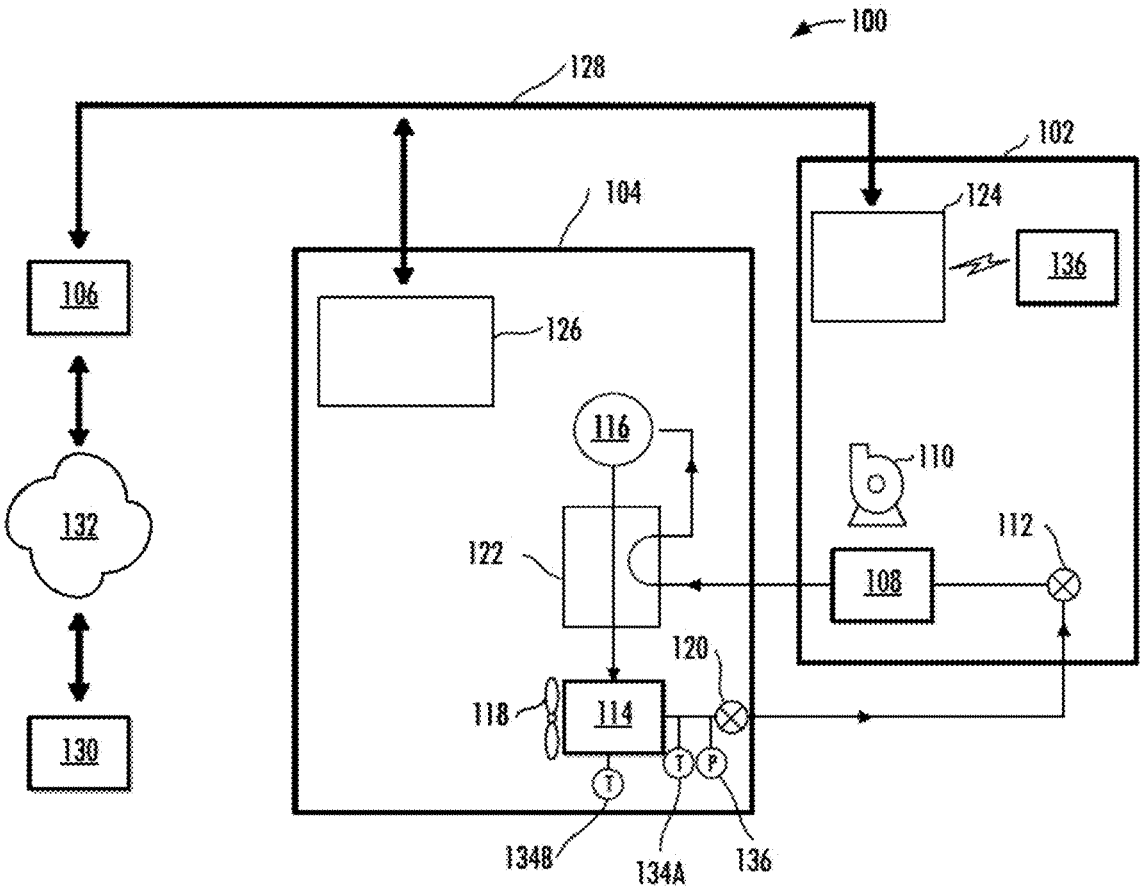
FIG. 1 is a schematic of a climate control system, according to an example embodiment of the present disclosure.

FIG. 1 shows a schematic diagram of a typical climate control system 100. In some embodiments, the climate control system 100 comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The embodiments depicted in FIG. 1 is configured in a cooling mode. The climate control system 100, in some embodiments is configured as a split system heat pump system, and generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between a refrigerant fluid carried within internal tubing of the indoor heat exchanger 108 and an airflow that may contact the indoor heat exchanger 108 but that is segregated from the refrigerant fluid.

The indoor metering device 112 may generally comprise an electronically controlled motor-driven electronic expansion valve (EEV). In some embodiments, however, the indoor metering device 112 may comprise a thermostatic expansion valve, a capillary tube assembly, and/or any other suitable metering device.

Outdoor unit 104 generally comprises an outdoor heat exchanger 114, a compressor 116, an outdoor fan 118, an outdoor metering device 120, a switch over valve 122, and an outdoor controller 126. The outdoor heat exchanger 114 may generally be configured to promote heat transfer between a refrigerant fluid carried within internal passages of the outdoor heat exchanger 114 and an airflow that contacts the outdoor heat exchanger 114 but is segregated from the refrigerant fluid.

The outdoor metering device 120 may generally comprise a thermostatic expansion valve. In some examples, however, the outdoor metering device 120 may comprise an electronically controlled motor driven EEV similar to indoor metering device 112, a capillary tube assembly, and/or any other suitable metering device.

In some examples, the switch over valve 122 may generally comprise a four-way reversing valve. The switch over valve 122 may also comprise an electrical solenoid, relay, and/or other device configured to selectively move a component of the switch over valve 122 between operational positions to alter the flow path of refrigerant fluid through the switch over valve 122 and consequently the climate control 100. Additionally, the switch over valve 122 may also be selectively controlled by the system controller 106, an outdoor controller 126, and/or the indoor controller 124.

The climate control system 100 may also include sensor. In the depicted example, the system includes both temperature sensors 134A and 134B, and pressure sensors 136. Any sensor may be used with the examples disclosed here. For example, the temperature sensor may be any device configured to measure temperature and provide a signal indicative of the temperature measured. In some examples, these sensors may be thermocouples, thermistors, or other types of sensors. Similar, the pressure sensor may be any device configured to measure pressure and provide a signal indicative of the pressure measured. In some examples, transducers or other pressure sensors are utilized.

These sensors (134 and 136) may be coupled to the various controllers or other electrical components discussed herein. Any communication signal used to transmit this information from these sensors. For example, these signals may electrical signals comprising a voltage and/or amperage indicative of the temperature measured by the temperature sensor. In other examples, the other communication processes may be utilized (e.g., optical signals, wireless communication protocols, etc.).

The system controller 106 may generally be configured to selectively communicate with the indoor controller 124 of the indoor unit 102, the outdoor controller 126 of the outdoor unit 104, and/or other components of the climate control system 100. In some embodiments, the system controller 106 may be configured to control operation of the indoor unit 102, and/or the outdoor unit 104. In some embodiments, the system controller 106 may be configured to monitor and/or communicate with a plurality of temperature and pressure sensors (e.g., sensors 134 and 136) associated with components of the indoor unit 102, the outdoor unit 104, and/or the outdoor ambient environment. Additionally, in some embodiments, the system controller 106 may comprise a temperature sensor and/or may further be configured to control heating and/or cooling of conditioned spaces or zones associated with the climate control system 100. In other embodiments, the system controller 106 may be configured as a thermostat for controlling the supply of conditioned air to zones associated with the climate control system 100, and in some embodiments, the thermostat includes a temperature sensor.

The system controller 106 may also generally comprise an input/output (I/O) unit (e.g., a graphical user interface, a touchscreen interface, or the like) for displaying information and for receiving user inputs. The system controller 106 may display information related to the operation of the climate control system 100 and may receive user inputs related to operation of the climate control system 100. However, the system controller 106 may further be operable to display information and receive user inputs tangentially related and/or unrelated to operation of the climate control system 100. In some embodiments, the system controller 106 may not comprise a display and may derive all information from inputs that come from remote sensors and remote configuration tools.

In some examples, the system controller 106 may be configured for selective bidirectional communication over a communication bus 128, which may utilize any type of communication network. For example, the communication may by via wired or wireless data links directly or across one or more networks, such as a control network. Examples of suitable communication protocols for the control network include TCP/IP, BACnet, LonTalk, Modbus, ZigBee, Zwave, Wi-Fi, SIMPLE, Bluetooth and the like.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication.

The indoor EEV controller 136 may be configured to receive information regarding temperatures and/or pressures of the refrigerant in the indoor unit 102. More specifically, the indoor EEV controller 136 may be configured to receive information regarding temperatures and pressures of refrigerant entering, exiting, and/or within the indoor heat exchanger 108.

The outdoor controller 126 may be carried by the outdoor unit 104 and may be configured to receive information inputs from the system controller 106, which may be a thermostat. In some embodiments, the outdoor controller 126 may be configured to receive information related to an outdoor ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116.

Figure 2:
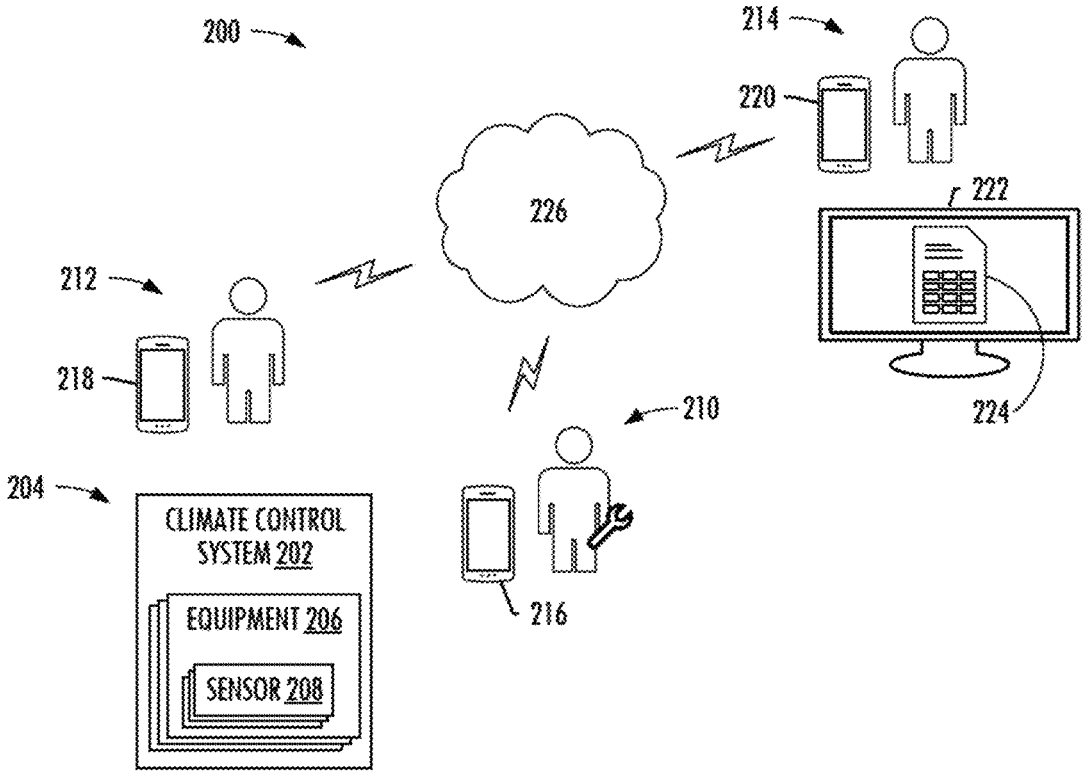
FIG. 2 illustrates a system for monitoring a climate control system, according to some example implementations of the present disclosure.

FIG. 2 provides an illustration of the devices that may communicate and display information regarding the method and systems discussed herein. In this example, the system 200 may be used to monitor the refrigerant charge level of a climate control system 202 located at a given facility 204. In some examples, the facility includes one or more buildings such as industrial buildings, institutional buildings, commercial buildings, residential buildings, and the like.

Even further, examples of suitable commercial buildings include office buildings, warehouses, retail buildings and the like.

The facility 204 is generally any facility with one or more environmental control systems configured to control environmental conditions for the facility. The environmental control systems may include, for example, a climate control system 202 with equipment 206, which may further include components (not shown in FIG. 2). The climate control equipment may include equipment such as air handling units, packaged units, chillers, etc. In some examples, the climate control system is the same as the climate control system 100 discussed above. The climate control system may further include sensors 208, which collect data regarding the climate control system, the climate control equipment, and/or the components thereof.

In the context of some example implementations of the present disclosure, the climate control system 202 may be installed at the facility 204 by a technician 210, and the technician may install, repair and/or maintain the climate control system. The climate control system may thereafter be placed in service at the facility. While in service by a customer 212 such as a proprietor of the facility, e.g., a homeowner, the climate control system may be monitored by various sensors 208.

The sensors 208 may be any sensor suitable for monitoring the climate control system 202 and the components thereof. These may include temperatures sensors, pressure sensors, refrigerant sensors, current sensors, voltage sensors, power sensors, and/or any other sensor that monitors a climate control system. For example, the sensors may be arranged in the configuration shown in FIG. 1 and discussed above. Further, multiple different arrangements and configurations for these sensors may be utilized for the present disclosure. Indeed, the examples set forth in this disclosure are not necessarily limited to a given sensor or configuration, but rather may utilize the information provided by these sensors to assess the underlying climate control system.

As will also be appreciated, computers are often used throughout the installation and operation of the climate control system 202; and in this regard, a "computer" is generally a machine that is programmable or programmed to perform functions or operations. The installation and operation of the climate control system at the facility 204 as shown makes use of several example computers. These computers may include communication devices 216, 218 and 220 used by the technician 210, customer 212 and/or service organization 214 to communicate with one another. In some examples, these computers receive data from one or more sensors 208, process that data, and/or send or receive data between the other computers.

A number of the computers 216-222 that may be used may be co-located or directly coupled to one another, or in some examples, various ones of the computers may communicate with one another across one or more networks 226, e.g., one or more telecommunications networks, computer networks, local area networks or the like. Indeed, any wired or wireless network may be used. Further, although shown as part of the system 200, it should be understood that any one or more of the computers may function or operate separate from the system, without regard to any of the other computers. It should also be understood that the system may include one or more additional or alternative computers than those shown in FIG. 2.

Examples of the present disclosure may be implemented throughout installation and operation of the climate control system 202, but are particularly well suited to monitor and assess the refrigerant level of a climate control system 202 during operation. Indeed, in some examples, these computers and/or the controllers within the climate control system may include control circuitry (discussed below in connection with FIG. 8) that may be configured to perform various processes discussed herein. For example, this system, and the control circuitry, may perform processes that monitor a climate control system and/or the components or operation of these systems. Further, the control circuitry may assess a refrigerant level based on this monitoring and provide an alert if the climate control system has an improper refrigerant level. Indeed, the below walks through example processes that may be utilized by the system 200.

As discussed above, the apparatus and method disclosed herein may be used for monitoring refrigerant charge loss within a climate control system. The refrigerant charge may be the mass of refrigerant fluid within the refrigerant circuit of a climate control system. In some examples, the desired refrigerant charge may be based on the capacity of the system, and in some examples, other factors are also relevant to determining the desired refrigerant charge, such as distance between the various components, e.g., indoor and outdoor heat units, the type of refrigerant, and other considerations. In some examples, each installed unit may have a desired level of refrigerant charge. In some examples, the climate control system may have or develop an improper level of refrigerant charge over time. This is often caused by a refrigerant leak within the refrigerant circuit, but other causes are also possible, e.g., improper sizing of the climate control system, etc.

In some examples, the apparatus and methods disclosed herein may monitor the subcooling performance of the climate control system, which may be useful to determine whether the refrigerant charge level within the climate control system is appropriate. This monitoring process may include determining subcooling values for the climate control system. These values may be based on measurements collected over time, which are used to determine the subcooling values. In some examples, the monitoring process further includes identifying a relevant set of subcooling values. This relevant set of values may be based on a plurality of parameters, examples of which are discussed in more detail below. Based on the relevant set of subcooling values, the monitoring process may further determine a representative subcooling metric for the climate control system. This representative subcooling metric may be compared to a target subcooling metric, and in some examples, this monitoring process provides an alert based on this comparison. This alert may be indicative of an improper level of refrigerant charge within the climate control system.

Figure 3:
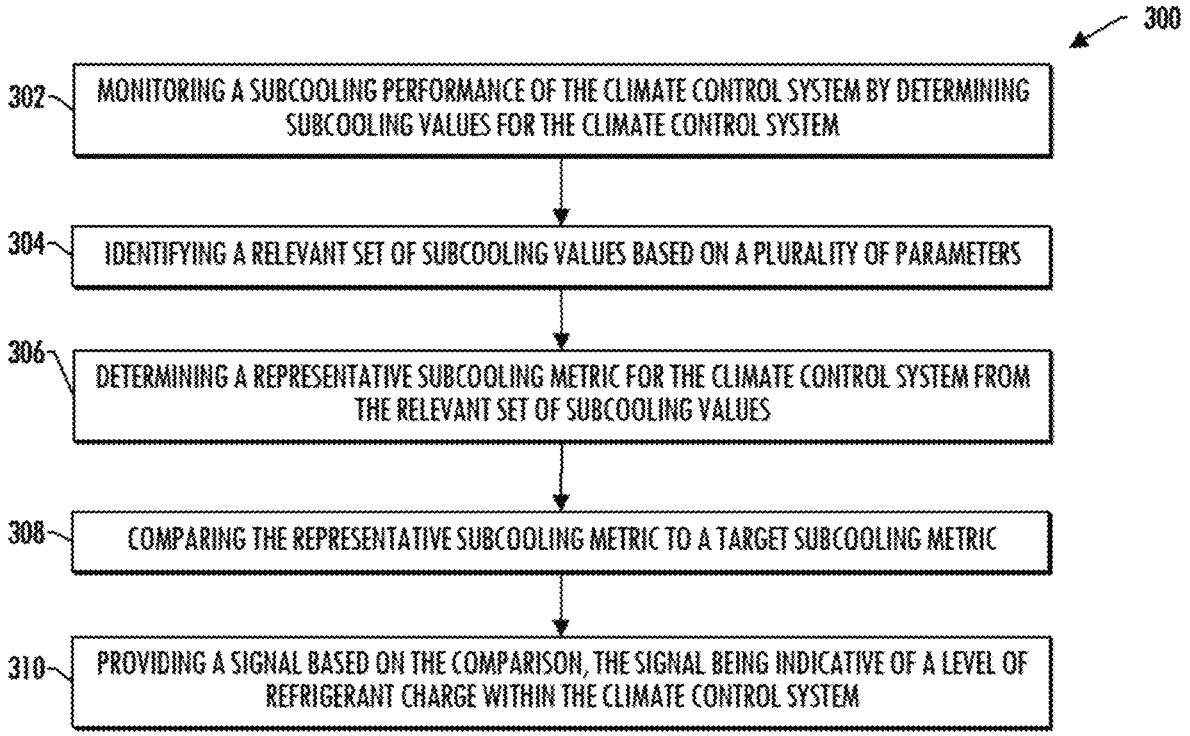
FIG. 3 illustrates an example process for monitoring the refrigerant charge level for a climate control system, according to some example implementations of the present disclosure.

FIG. 3 provides an illustration of a monitoring process 300. This process may include monitoring a subcooling performance of the climate control system, as showing in step 302, and in some examples, the subcooling performance includes determining a plurality of subcooling values for the climate control system. The process may further include identifying a relevant set of subcooling values based on a plurality of parameters, as shown in step 304. In addition, the process may determine a representative subcooling metric for the climate control system from the relevant set of subcooling values, as shown in step 306. The process may also include comparing the representative subcooling metric to a target subcooling metric, as shown in step 308. The process may further include providing an alert based on the comparison, as shown in step 310. The alert may be indicative of an improper level of refrigerant charge within the climate control system. The below walk through these process steps in more detail.

The subcooling performance may be monitored at step 302 in various ways. As an initial matter, subcooling generally refers to the refrigerant temperature in liquid form, and subcooling is generally the temperature at which the liquid refrigerant is below the temperature of condensation for that refrigerant fluid at a given pressure condition. A refrigerant fluid may achieve a subcooling temperature at various different locations within the refrigerant circuit. Often the refrigerant fluid reaches a subcooling temperature after passing through the condensing heat exchanger, e.g., the outdoor heat exchanger in cooling mode, and before the refrigerant fluid passes through the evaporating heat exchanger, e.g., indoor heat exchanger in cooling mode.

In some examples, the subcooling values may be determined using various temperature and/or pressure sensors. For example, the subcooling value for a given refrigerant fluid may be determined using both the temperature measurements from a temperature sensor and the pressure measurements from a pressure sensor. These sensors may be located at locations where the refrigerant fluid is likely to be in a liquid state, potentially proximate the outdoor heat exchanger. In these examples, the subcooling temperature of the refrigerant fluid may be determined by the temperature and pressure of the refrigerant fluid based on the type of refrigerant fluid being utilized. For example, a lookup table may be used to convert the temperature and pressure values to a subcooling value for a given refrigerant. In other examples, the subcooling value may be calculated, modeled, or otherwise determined from these temperature and pressure values. In some of these examples, the distance the temperature and pressure sensors are located from the outdoor heat exchanger is taken into account as part of the determination of subcooling. Other methods may also be used and/or the sensors may be located elsewhere.

In some examples, the subcooling value for a given refrigerant fluid may be determined using two different temperature measurements. These temperature measurements may be from two temperature sensors located at different points along the refrigerant circuit. In these examples, one temperature sensor may be located at a location where the refrigerant fluid may be in a mixed state comprising both gas and liquid, e.g., the outdoor heat exchanger, and another temperature sensor may be located at a location where the refrigerant fluid may be a liquid, e.g., between the outdoor heat exchanger and the indoor heat exchanger as discussed above. In these examples, the temperature sensor monitoring the temperature of a mixed refrigerant fluid may be used to determine the condensing temperature of the refrigerant fluid at a given pressure or outdoor ambient condition. The temperature sensor monitoring the temperature of the liquid refrigerant fluid may be used to determine the subcooled temperature, e.g., the subcooled value.

To further illustrate configurations that may be utilized, reference is made to FIG. 1. This diagram includes multiple sensors (e.g., 134 and 136) located along the refrigerant circuit. In the depicted example, a pressure sensor 136 and a temperature sensor 134A are located in the outdoor unit 104 proximate the outdoor heat exchanger 114. As discussed above, locating the sensors at this location, downstream from the outdoor heat exchanger in cooling mode, may allow the sensors to monitor the pressure and temperature of the refrigerant fluid in liquid form. In other examples, these sensors may be located further downstream from the outdoor heat exchanger. For example, these sensors may be located proximate the indoor heat exchanger 108, e.g., upstream from the indoor heat exchanger in cooling mode. Other locations may also be utilized to monitor the refrigerant fluid in a liquid state.

In addition, the example depicted in FIG. 1 includes a temperature sensor 134B located on the outdoor heat exchanger 114. In some examples, this temperature sensor is located on the outdoor heat exchanger coil (not shown). In some examples, this temperature sensor provides information regarding the refrigerant fluid in a mixed state, e.g., comprising both gas and liquid refrigerant fluid. As a result, this temperature sensor may provide an indication regarding the condensing temperature of the refrigerant fluid at a given pressure and/or outdoor ambient condition. Further, in some examples, the condensation temperature (or evaporation temperature) of the outdoor heat exchanger may be advantageous because that temperature is associated with the outdoor ambient conditions. Other locations may be utilized for this temperature sensor.

The temperature and pressure measurements received from these sensors may be utilized to determine subcooling values for the refrigerant fluid within the refrigerant circuit of the climate control system. In some examples, these measurements are taken and received over time, potentially continuously. As result, the subcooling values and correspondingly the subcooling performance, may be monitored and tracked over time.

The process 300 may identify the relevant set of subcooling values at step 304 in various ways. This identification may be useful to determine a consistent set of subcooling values, which may be easily comparable. In some examples, the identification is used to determine subcooling values directed to a steady-state operation for the climate control system. For example, the process may identify instances where the compressor is operating at a high speed, which in some examples may indicate a stable, steady-state operation.

In some examples, the process 300 identifies the relevant set of subcooling values at step 304 based on a plurality of parameters. These parameters may be useful to determine whether the subcooling values are relatable, and potentially, whether or not the subcooling values are associated with a steady-state operation of the climate control system.

In some examples, the plurality of parameters includes determining one or more time periods while a compressor of the climate control system is operating above a speed threshold. In some examples, the compressor may be the same or substantially the same as the compressor discussed above in connection with FIG. 1, e.g., compressor 116. Further, in some examples the speed threshold is a percentage of the maximum speed for the compressor. In some examples, the speed threshold is based on both the maximum speed for the compressor and the given outdoor temperature. These examples may use a lookup table to determine the appropriate speed based on the outdoor temperature. In these examples, the maximum speed may further be set based on the outdoor temperature. In some examples, the lookup table is based on the model number or type of compressor (or climate control system) utilized. Other techniques may also be used.

The percentage of the maximum speed may be any value, and in general, this value is indicative of a higher-speed operation for the compressor. In some examples a value of about 90% maximum speed, potentially 90% maximum speed based on ambient conditions, is used. In other examples a narrower band, e.g., 97% maximum or maximum based on ambient conditions, is used. In some examples, an angular velocity is utilized as the speed threshold. For example, an angular velocity of over 50-60 revolutions per second (RPS) may be utilized. In still further examples, the speed threshold may be based on the conditioning mode. In these examples, the speed threshold of the compressor may be based on the mode of operation, and a similar process may be utilized as discussed above, e.g., the speed threshold may be based on the maximum speed determined for the compressor or a given value. In these examples, the outdoor ambient temperature may (or may not) be utilized to determine the speed threshold. In still other examples, the compressor speed may be mapped to potential subcooling values, which may allow for a broader range of compressor speeds to be utilized.

To further illustrate potential speed thresholds, in some examples the speed threshold for a compressor is based on the conditioning mode and the outdoor ambient temperature. In these examples, the speed threshold value for cooling mode may be 56 RPS for the compressor. This speed threshold value may be the same regardless of the outdoor ambient temperature, while this climate control system operates in a cooling mode. In these examples, the speed threshold value for heating mode may be dependent on the outdoor ambient temperature. In these examples, the speed threshold value for heating mode may be 75 RPS if the outdoor ambient temperature is less than 25° F. As the outdoor ambient temperature increases, the speed threshold value may correspondingly decrease. For example, the speed threshold value may be 70 RPS, when the climate control system is operating in heating mode and the outdoor ambient temperature is between 25° F. and 35° F. And in these examples, while the climate control system operates in heating mode the speed threshold value may be 65 RPS when the outdoor ambient temperature is between 35° F. and 40° F., and it may be 60 RPS when the outdoor ambient temperature is between 40° F. and 45° F. It may also be 56 RPS if the outdoor ambient temperature is greater than 45° F. and the system is operating in a heating mode. Different values and configurations may also be utilized to determine the speed threshold value for use with the examples disclosed herein.

In some examples, additional parameters are utilized to determine the relevant set of subcooling values at step 304. These parameters may include a compressor runtime parameter, an outdoor ambient temperature range parameter, a superheat parameter, an airflow rate of change parameter, as well as others. Again, these parameters may be used to confirm that the subcooling values are indicative of the subcooling performance of the overall climate control system. In some examples, these parameters are utilized to confirm the climate control system is in a steady-state operation. For example, these parameters may confirm the climate control system is in a state where, in cooling mode, the heat transported out of the conditioned space by the climate control system is approximately equal to the heat generated or entering the space from other sources. Or these parameters may confirm the climate control system is in a state where, in heating mode, the heat transported into the conditioned space by the climate control system is approximately equal to the heat leaving the conditioned space less the heat generate by internal sources within the space. Other conditions may also be considered steady state.

To walk through these parameters in more detail, the compressor runtime parameter may be utilized to confirm the compressor had been operating for a sufficient length of time. This may help remove any transient subcooling values associated with the start of a given conditioning cycle. In these examples, the process 300 may confirm that the compressor runtime has exceeded a minimum runtime before determining that subcooling values may be relevant to the overall performance of the climate control system. This minimum runtime may be any period of time generally indicative of how long the temperatures take to establish a steady-state condition. In some examples the minimum runtime value is between 5 and 10 mins, and in further examples, this value is 7 mins.

Another parameter that may be utilized is the outdoor ambient temperature parameter. In these examples, the process 300 may confirm that the outdoor ambient temperature range is within a target outdoor ambient temperature range. This may be utilized to confirm that the climate control system is operating in an environment that is within the design parameters of the climate control systems, e.g., the subcooling values are not related to an overly hot or overly cold edge case. In some examples, the outdoor ambient temperature parameter may be utilized to confirm that the climate control system is operating in the appropriate mode, e.g., heating mode while the outdoor environment is at a low temperature, etc. In some examples, the outdoor ambient temperature parameter may be assessed by confirming the outdoor temperature is within a target outdoor temperature range. For example, the process may confirm that the outdoor temperature range is between a minimum and maximum outdoor ambient temperature during a cooling mode, potentially over 55° F. and under 147.5° F. Similarly, the process may also confirm that the outdoor temperature range is between a minimum and maximum outdoor ambient temperature during a heating mode, potentially over 0° F. and under 75° F. In some examples, only a single value is used, e.g., a maximum temperature is utilized for a cooling mode and a minimum temperature utilized for heating mode. In these examples, the outdoor ambient temperature parameter may be useful to identify and select subcooling values that correspond to outdoor ambient temperatures within the outdoor ambient temperature range. Other configurations and values may be utilized according to the examples disclosed herein.

Another parameter that may be utilized is a superheat parameter. Superheat is typically the temperature for the refrigerant fluid above the evaporation temperature of the refrigerant fluid at a given pressure. The superheat value is used in some climate control systems to control the thermal transfer at the evaporator coil during cooling mode, e.g., to control the expansion valve at the indoor heat exchanger. In some examples, a consistent, or reasonably consistent superheat value may be indicative of a steady-state operation for the climate control system. As result, in some examples the process 300 confirms that the superheat value is within a target superheat range, e.g., between 5° F. and 15° F. In some examples, the process 300 confirms that the superheat value is over a target superheat value. In these examples, the subcooling values that correspond to these superheat values are identified and selected for the relevant set. Other configurations and values may be utilized.

A further parameter that may be utilized when identifying the relevant set of subcooling values may be an airflow rate of change metric. In some examples, this metric may relate to the indoor, or conditioning, fan, e.g., indoor fan 110 in FIG. 1. In these examples, a consistent airflow rate at the conditioning fan may indicate that the climate control system is operating in a steady-state. Thus, in some examples, the process 300 may confirm that this airflow rate is within a given range. For example, the process may confirm that the airflow rate of change is less than 20 cubic feet per min (CFM)/min. Subcooling values that correspond to the desired airflow rate of change may be selected and identified for the relevant set. Other values and parameters may be utilized.

The process 300 may use each of these parameters to determine the relevant set of subcooling values. For examples, the process may select the subcooling values that correspond to a time period when one or more of these parameters is met. In some examples, the process selects the subcooling values when all of these parameters are met. As a result, the subcooling values may all relate to the same or similar operation of the climate control system. Further, these values may also be indicative of the subcooling performance of the climate control system during normal or steady-state operation. Other processes or parameters may be utilized to determine the relevant subcooling values.

The process 300 may also determine a representative subcooling metric at step 306. This representative subcooling metric may come in various forms, e.g., a set value, a trend line, a rate of deviation, etc. In some examples, the representative subcooling metric is determined from the relevant set of subcooling values.

To walk through some examples, the representative subcooling metric may be an average of the relevant subcooling values, potentially over a given time period. For example, the time-period may be a day, and the representative subcooling metric may be the daily average of the relevant subcooling values. Other time periods may also be used, e.g., weeks, months, etc. In some examples, the representative subcooling metric may be a weighted average of the relevant subcooling values. This weighed average may also be over a given period, e.g., a day, a week, a month, etc. In some examples, the weighted average may be a time-weighted average, where each subcooling value is weighted based on the amount of time the given subcooling value is measured during the given period of time. To walk through a brief example, the period of time may be one day in this example. Multiple subcooling values may be taken during that day, and each of these subcooling values may last for a given time. For example, a subcooling value of 5° F. may be measured for 5 minutes and a subcooling value of 10° F. is measured for 50 minutes during the day. In some examples, a weighted average of these values may be used, where the 5° F. subcooling value is weighted by the 5 minutes time period and the 10° F. subcooling value is weighted by the 50 minute time period. Thus, in this example, the weighted subcooling value for these two subcooling values would be approximate 9.5° F.

In some examples, the representative subcooling metric may be a set value. This may include examples where the representative subcooling metric is an average (or weighted average). In these examples the representative subcooling metric and the target subcooling metric may be directly compared. For example, the process 300 may set the target subcooling metric to a desired lower limit for subcooling, e.g., 5° F. In these examples, if the target subcooling metric is determined to be less than this desired lower limit, e.g., 5° F., then the process may determine that the level of refrigerant may be improperly low.

In some examples, the target subcooling metric includes a minimum subcooling value and a maximum subcooling value. In these examples, the process may set the desired minimum subcooling limit, e.g., 5° F., and a desired maximum subcooling limit, e.g., 15° F. In these examples, the process 300 may determine if the representative subcooling metric, e.g., the average value determined at step 306, is between the minimum subcooling value and the maximum subcooling value. If the representative subcooling metric is lower than the minimum subcooling limit it may indicate that the refrigerant level is under charged, potentially due to a leak. If the representative subcooling metric is higher than the maximum subcooling limit it may indicate that the refrigerant level is over charged.

In some examples the representative subcooling metric may be a representative subcooling trend, e.g., a trend line. This representative subcooling trend may be determined in various ways. For example, a trend line may be determined from a linear regression of the representative subcooling values over a given timeline. In these examples, the trend line may map the daily subcooling values for each day. For example, the subcooling values for each day are charted and the linear regression is performed on the data. Other time periods or groupings may also be used.

In some examples, the linear regression may provide both a trend line and a confidence interval. In these examples the trend line may provide the best linear fit and the confidence interval may provide a range of potential trend lines. In some examples, the confidence interval is defined by a given confidence value, e.g., 85%, 95%, 97.5%, etc.

In some of these examples, determining the representative subcooling trend for the climate control system further includes filtering the relevant set of subcooling values. In these examples, the filtering may refine the relevant subcooling values, which may be beneficial to ensure the trend line is mapping comparable and/or meaningful values. This filtering may include multiple refinements to the relevant set of subcooling values. For example, the filtering may include applying a time window, smoothing the values, validating the values, confirming a minimum number of values, confirming a minimum time span for the values, or other techniques. In some examples, the filtering process applies only one refinement technique, in other examples some or all of the techniques are utilized.

To walk through these techniques in more detail, applying a time window may be used to limit the relevant set of subcooled values to a relevant time frame. For example, the process 300 may limit the trend line to only mapping the subcooling values for the last few months, e.g., 61 days. In these examples, applying the time window may be limiting the relevant set of subcooled values to only the relevant time window, e.g., 61 days. Subcooling values may be discarded if those values are not within the relevant time window. Other time windows and durations may be used.

Smoothing the relevant set of subcooling values may include removing subcooling values that differ significantly from other values. For example, if a given value represents a step change from the preceding and/or subsequent value then in some examples the smoothing removes that value from consideration. This process may include comparing a given value to adjacent values, proximate values, or in some cases expected values, and smoothing the overall data by discarding values deemed to be outliers. To walk through an example, the smoothing process may look for large day-to-day changes. In some examples, the mean and standard deviation of the absolute value of change in subcooling values from one day to the next may be determined for all the subcooling values in a relevant set of subcooling values. In these examples, any day-to-day change that is more than a given number of standard deviations, e.g., 3.5 standard deviations, above the mean is flagged. Once that subcooling value is flagged it may be compared with the next day-to-day change to determine if the flagged subcooling value should be discarded. If the next day-to-day change is at least as large by a given percentage, e.g., 50%, and in the opposite direction, then the flagged subcooling value may be considered a large fluctuation and dropped from the fit. In some examples, the flagged subcooling value is further compared with the day-to-day change value for the previous day(s). If in these examples, the change from these previous day(s) are about the same size (at least 90% of the previous day(s)) then the change is considered a step change and all the data before the step change is dropped from the data set. Other values or comparisons may be utilized.

In some examples, the filtering process also includes validating the subcooling values. This process may include ensuring that a minimum number of values are present and/or that the values span a minimum length of time during an operation of the climate control system. For example, the process may validate the various subcooling values by ensuring that each value represents at least two minutes or more of operational time for the climate control system in a given cycle. In other examples, the validation process may ensure that a minimum number of subcooled values are included within a time period, e.g., five (5) different subcooled values over the course of the day. Other values and validation processes may be utilized.

In some examples, the filtering process further includes confirming that a minimum number of values are included. This may be particularly relevant when a regression analysis is performed, and this confirmation may ensure that sufficient data points are available to perform a reliable fit analysis. Thus, in some examples, if the data set is too small, e.g., less than 10 days of relevant, filtered data, then the regression analysis may not be performed.

In some examples, the filtering process further includes confirming that the subcooled values span a minimum time span. This minimum time span may be defined based on the timing of an initial subcooling value compared with the timing of the last subcooling value in the same data set. In these examples, the filtering process may ensure that at least a minimum number of data points is present for the specified time interval, e.g., at least a 30-day spread in the data.

Other filtering processes may be utilized, and these processes may be combined in a variety of different ways to determine a filtered data set of subcooling values for the regression analysis. In addition, as indicated above, often the filtering process is performed on a relevant set of subcooled values which have already been culled by the identification process at step 304 discussed above.

Various regression analyses may be utilized on the subcooled values. In general, these regression analyses are directed to identifying a curve fit for the subcooling values. Often, the regression analysis is performed on the relevant set of subcooled values, which may have gone through one or more the processes discussed above. In some examples, a linear regression is performed, and in these examples, a linear trend line may be fitted to the subcooled values. In addition, the regression analysis may also determine a confidence interval, which may provide a range of potential linear trend lines based on the data. The below discusses example linear trend lines, however it is understood that multiple different types of regression analysis and fit patterns may be utilized according to the disclosed examples herein.

In some examples, where a trend line is used as the representative subcooling metric, the target subcooling metric may also be a trend line. In some of these examples, the target subcooling metric may be two or more trend lines, potentially an upper trend line and a lower trend line. In some examples, the representative subcooling trend line is compared to the target subcooling trend line to determine whether the climate control system contains an appropriate level of refrigerant charge. In these examples, the comparison may further indicate whether refrigerant fluid is leaking from the climate control system, and in some examples, this comparison may provide an indication regarding the rate of the leak, e.g., whether it is a fast leak or not.

FIGS. 4A-F provide illustrations of how linear trend lines may be used as part of this comparison. In these examples, the chart maps subcooling values on the y-axis axis 402 and time on the x-axis 404. The subcooling values and trends in these illustrated examples are shown as decreasing, e.g., negative values. That is because, as discussed above, subcooling is the difference between the temperature of condensation and the current liquid temperature, which is typically less than temperature of condensation for a given refrigerant at a given pressure value. Thus, the subcooling temperature is typically a given temperature a refrigerant is at that is below the higher temperature of condensation. Thus, the subcooling temperature is typically a negative value, but it is often discussed in the absolute terms, e.g., as a positive value. For example, this application often discusses the subcooling value in the absolute terms, e.g., as a positive value. Again, however, FIGS. 4A-F are only illustrative examples of trend lines and values that may be utilized by the examples disclosed herein. Other trend lines may be mapped differently, including using a positive value for the subcooling values or other techniques.

Further, in the examples depicted in FIGS. 4A-F the representative subcooling trend line is indicated by the solid line 406, and the dashed lines at 408 represent the confidence interval span for a subcooling trend line. The target subcooling metric in these examples also includes an upper and lower limit. The upper limit 412 is represented by a straight line parallel to the x-axis, which would generally be indicative of zero leakage of refrigerant fluid over time within the climate control system. The lower limit is represented as line 410. In some examples, the lower limit 410 of the target subcooling metric may be indicative of what would be considered a fast, or a critical, leak within the climate control system. For example, a rate of change of over −0.08° F. per day (e.g., approximately a decrease of 5° F. in subcooling over two months) may be considered a critical or fast leak. In addition, in some examples, the system has an initial subcooling value 414. This initial subcooling value may be the standard subcooling value the climate control system is designed for or set to in a conditioning mode, potential a cooling mode. In some examples, the initial subcooling value is between 5° F. and 15° F., and potentially set to 10° F. Thus, in these examples, the various trend lines are based off this initial subcooling value. Other values or metrics may be utilized to classify a rate of leakage within the refrigerant circuit.

Figure 4A:
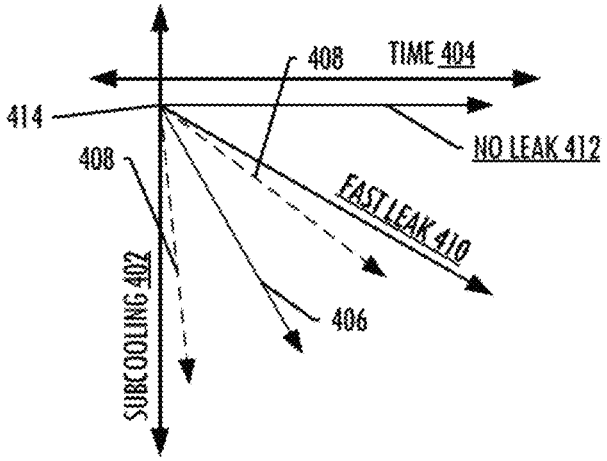

The comparison represented in FIG. 4A may indicate that the refrigerant fluid within the climate control system is leaking at a high rate, e.g., there is a "fast" leak. In this example representative subcooling trend line 406 is below the lower limit 410 of the target subcooling trend line. Further, both confidence interval lines 406 are also below the lower limit, indicating that the full range for the linear trend line is below the lower limit. As a result, a comparison of this type may provide an indication that the climate control system is leaking refrigerant fluid at a fast rate.

Figure 4B:
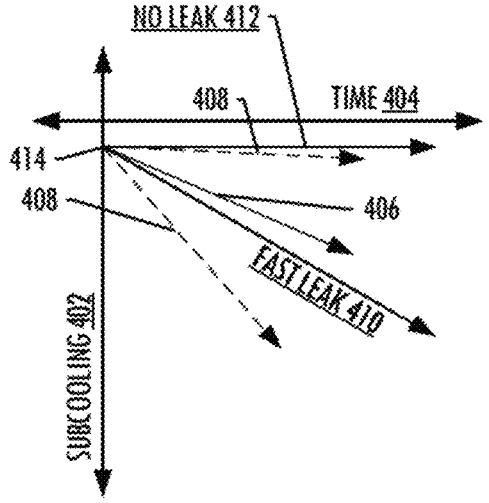

The comparison represented in FIG. 4B may indicate that the refrigerant fluid within the climate control system is leaking, e.g., that there is a leak of some type in the climate control system. In this example, the representative subcooling trend line 406 is below the upper limit 412 and above the lower limit 410 of the target subcooling trend line. However, confidence interval lines 406 span the lower limit. In this comparison both confidence interval lines are below the upper limit 412 for the target subcooling trend line. As result, this comparison may indicate that the climate control system may include a refrigerant leak. Further this comparison may also indicate that the data is not yet sufficient to deem the leak a fast leak.

Figure 4C:
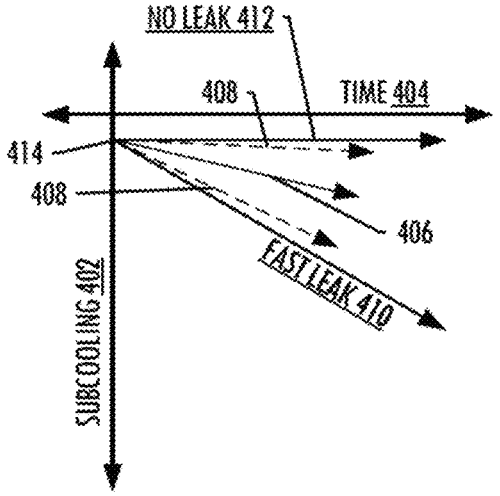

The comparison represented in FIG. 4C may be indicative of a marginal leak of refrigerant fluid within climate control system. In this example the representative subcooling trend line 406 and both confidence interval lines 408 are below the upper limit 412 and above the lower limit 410 of the target subcooling trend line. As result, this comparison may indicate that the climate control system may include a manageable refrigerant leak. In some examples, this manageable leak may be acceptable without immediate action by the homeowner or technician.

Figure 4D:
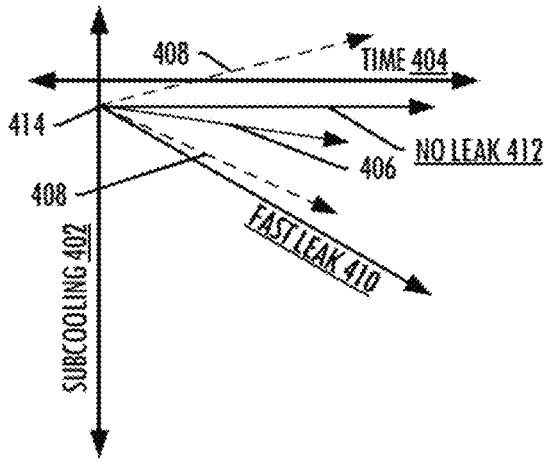

The comparison represented in FIG. 4D may be indicative of a stable climate control system. In this example the representative subcooling trend line 406 is below the upper limit 412 and above the lower limit 410 of the target subcooling trend line. In addition, one of the confidence interval lines 408 is above the upper limit 412 of the target subcooling trend line and the other confidence interval line 408 is below the upper limit 412 and above the lower limit 410 of the target subcooling trend line. As result, this comparison may indicate that the climate control system may be stable.

Figure 4E:
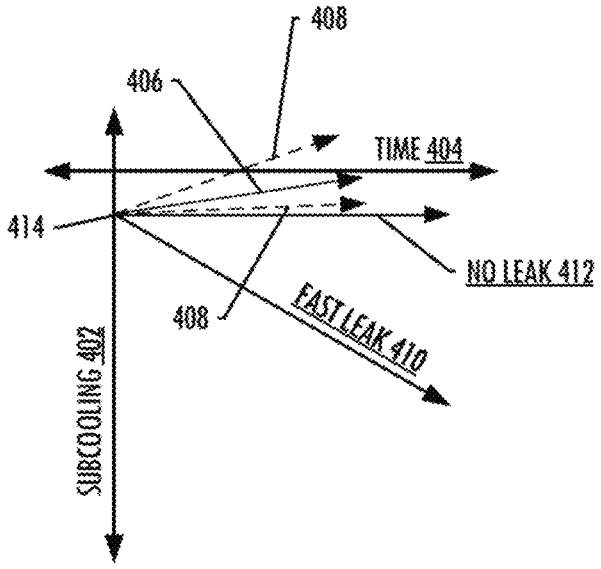

The comparison represented in FIG. 4E may be indicative of a rising level of refrigerant fluid within the climate control system, which is improbable. As indicated in this illustration, the representative trend line 406 and both confidence interval lines 408 are above the upper limit 412 of the target subcooling trend line. Given that there are limited mechanisms during normal operation for refrigerant fluid to increase subcooling, these results may be indicative of a statistical inaccuracy and/or a generally stable system. In some examples, this result may be indicative that service has been performed on the climate control system.

Figure 4F:
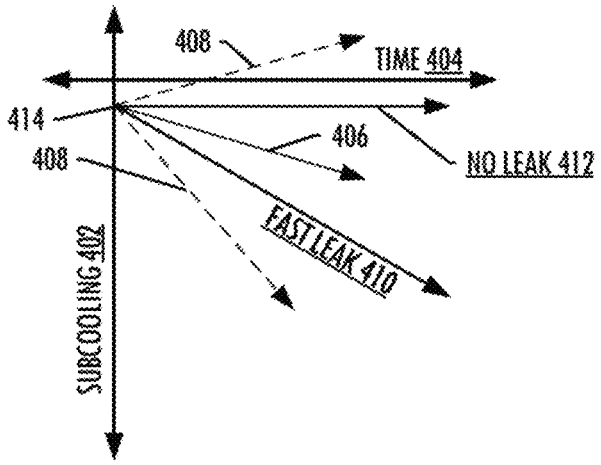

The comparison represented in FIG. 4F may not provide any usable information. As indicated in this illustration, the representative trend line 406 may be between the upper limit 412 and the lower limit 408 of the target subcooling trend line. However, in this example, the confidence interval lines 406 span both the upper limit 404 and the lower limit 408. As result, this comparison may provide limited or no information regarding the refrigerant level of the underlying climate control system.

In some examples, the representative subcooling metric and the target subcooling metric may include two or more metrics. For example, the representative subcooling value may contain a first metric, which may be a set value, and a second metric, which may be a trend line. The target subcooling metric may also include analogous metrics. These multiple metrics may be useful to assess the underlying climate control system in more detail.

To walk through an example, the first metric of the representative subcooling metric may be the daily average of the subcooling values. In some examples, the second metric of the representative subcooling metric may be a trend line of the daily subcooling values. In these examples, the daily subcooling average may be determined by any of the above processes, and that daily subcooling average may be compared to a target subcooling value (or range of values) to determine if a refrigerant leak has occurred. In some examples, if this comparison determinates that a leak may have occurred an alert is provided. In some examples, the process further compares the second metric of the representative subcooling metric, which may be the trend line for the daily average values. This trend line may be compared to the second metric for the target subcooling metric using any of the processes discussed above. In some examples, if the comparison of the first metrics indicates a leak has occurred (or that there is an improper level of refrigerant charge), the comparison of the second metric may provide an indication of the rate at which the leak has occurred. In some examples, the comparison of both metrics may be utilized to determine if a leak has occurred. For example, if the trend lines provide an indication that a manageable leak is occurring or the data does not provide usable information, then the comparison of the set value (e.g., the first metric) may provide further information. For example, a leak may be determined if the daily average of the subcooling value is within a range associated with the daily target subcooling value. Other combinations and comparisons may be utilized with the examples disclosed herein.

Returning to FIG. 3, the process 300 may further provide a signal indicative of subcooling based on the comparisons discussed above, at step 310. This signal may be indicative of the level of refrigerant charge within the climate control system. For example, the signal may indicate that the level of charge is appropriate or acceptable for the climate control system. In other examples, the signal may indicate that the level of refrigerant charge is improper, potentially to low. In some examples, the signal may be indicative of a refrigerant leak. In some instances, the process may provide an indication of the severity of the leak. Further, in some examples, the signal provides an indication of the rate of a refrigerant leak. In some examples, the rate of the refrigerant leak is directional, e.g., fast, slow, etc, and in other examples, the rate of refrigerant leak is a numerical approximation of the actual leak, e.g., −0.03° F. per day, etc.

In these examples, the signal may be any type of communication signal, and in some examples multiple signals are send. For example, each signal may be representative of the level of refrigerant charge at a given time. Further, various signals may be indicative of different types of information, e.g., a signal may be an alert that the level of refrigerant charge is too low and another signal may be indicative of the rate of charge loss. Other forms and combinations may also be utilized.

In some examples, the signal may be sent to any of the computers or controllers discussed herein, and potentially displayed on a display, e.g., potentially in the form of an alert or an alarm. In some examples, the signal may result in a noise, providing an indication of the underlying condition, e.g., an alarm bell that indicates the level of refrigerant charge is too low. In some examples, the climate control system may take corrective action based on the signal. For example, the compressor may be shut off if a leak is determined and/or the indoor fan may operate to dilute any refrigerant within the indoor unit. In some examples an exhaust fan (not shown) may be activated. In further examples, the signal may be sent to a technician who services the climate control system.

FIGS. 5-7 provide further example processes for determining the representative subcooling metric, the target subcooling metric, and comparing these values. These processes may include the same or similar steps discussed above.

FIG. 5 provides an example process 500 where the representative subcooling metric is based on the variation of the subcooling values over time. This process includes determining the subcooling values for a given unit at step 502. This process may be the same or similar to the monitoring process discussed above at step 302. In addition, this process may collect these values for a given period of time, e.g., 30 days. Again, this process, step 504, may be the same or similar to the identification step discussed above at step 304. In some examples, the identification of the relevant set of subcooling values at step 504 may be based on timing alone, however often, one or more of the parameters discussed above in connection with step 304 are also utilized.

Continuing the example process 500 shown in FIG. 5, the representative subcooling metric may be determined at step 506. Again, this process step may be the same or similar to step 306. In some examples, step 506 in the process 500 determines an average deviation of the subcooling values identified as shown in step 506. In some examples, a daily average of the subcooling values is determined and the representative subcooling metric is the average deviation of these daily averages over a period of time. For example, a running average of these daily deviations may be determined over the previous 30 days (or other time periods) and the representative subcooling metric may be this running average.

In this example, the target subcooling metric may be a set deviation value, e.g., +/−3° F., and the representative subcooling metric may be compared to the target subcooling metric at step 508 in the same or similar manner as discussed above at step 308. In these examples, at this step 508, the running average may be compared against the set deviation value to determine whether the climate control system has a refrigerant a leak. If the running average is within the set deviation value, then the process 500 may determine that no leak is present, as shown at step 510. However, if the running average is outside the set deviation value, then the process may determine that a leak exists, as shown at step 512. In these examples, the process 500 may provide an alert indicating that the climate control system has an improper level of refrigerant change. In some examples, the process initiates the other actions, e.g., mitigation, etc., discussed above. This process may be the same or similar to the process discussed above at step 310.

FIG. 6 provides another example process 600 that may be utilized to monitor the refrigerant charge of a climate control system. In this example, the target subcooling metric may be based on a simulation model. This simulation model may be derived from a plurality of inputs. In some examples, the simulation model is further derived from the plurality of inputs along with testing data associated with a given climate control system.

In the example depicted in FIG. 6, the process 600 includes process steps 602 through 610, some or all, of which may be utilized to determine the simulation model used as the target subcooling metric. In these examples, the input variables to the simulation model may be determined at step 602. These inputs may include information regarding the climate control system, e.g., capacity size, refrigerant type, energy efficiency ratio, or other similar types of information. These inputs may further include information regarding the installation location for the climate control system, e.g., geographical information (which would include annual weather/external load data), facility size, facility type (which may be indicative of internal load), etc.

In these examples, the process 600 may use these inputs to run a simulation at step 604. This simulation may be based on the input variables determined at step 602. The simulation may map the performance of various components within the climate control system and determine the various operational parameters. In these examples, the simulation may map the subcooling performance for the climate control system. In some examples, the subcooling performance mapped by the simulation may include various parameters and/or conditions. For example, the simulation may be performed using Trex or other simulation programs. In these examples, the indoor coil temperature and outdoor coil temperature may be simulated for various fixed speed compressor and/or fan conditions. Other system parameters may also be fixed such as conditioning mode, temperature setpoint, etc. This simulation may further determine subcooling performance at these values, potentially as other conditions vary such as outdoor temperature, internal heat load, etc. Indeed, any type of simulation may be utilized according to this process step.

The process 600 may further output a model climate control system at step 606. In these examples, the model may further include a model subcooling performance for the climate control system. In some examples, this model subcooling performance may be the target subcooling metric utilized in the monitoring process discussed herein. In other examples, the output of the simulation determined at step 606 is further refined based on testing data. In these examples, a model or exemplary model climate control system may be tested at step 608. This climate control system being tested may include some or all of the input parameters utilized in step 602, and the testing performed may be used to confirm or refine the output simulation from step 606. In these examples, the process may create the simulation model based on both the input parameters and the testing data, as shown at step 610. This refined simulation model may provide more detailed information regarding the desired or expecting subcooling performance.

In some examples, the output of the simulation at step 610 (or 606) may be used to determine the target subcooling metric. Similar to the above examples, the target subcooling metric can be any form, e.g., set value, trend line, etc. In addition, in some examples, utilizing a simulation model may be beneficial to develop the target subcooling metric. For example, the simulation model may be used to develop specific set values, trend lines, etc., for a given climate control system or type of climate control system. In addition, in some examples, the simulation model may be used to develop more complex target subcooling metrics. For example, discrete patterns may be discerned in the subcooling performance, potentially based on load or other factors, and these patterns may be utilized as these target subcooling metric.

The remaining steps in process 600 may mirror the process steps discussed above. For example, the representative subcooling metric may be compared to the target subcooling metric at step 612. In some examples, if the representative subcooling metric matches or substantially follows the target subcooling metric, the process determines that the climate control system has an appropriate level of refrigerant charge at step 614. If the representative subcooling metric does not match or substantially follow the target subcooling metric, the process may determine a leak exists at step 616. Other comparisons discussed herein may also be utilized with this process. In some examples, if the process determines a leak exists an alert or other action may be taken as discussed herein.

FIG. 7 provides another example process 700 that may be utilized. In this example, the subcooling values may be collected for a given time period, e.g., 60 days, at step 702. This may again be the same or similar to the identification process discussed above. In some examples, the process may further include grouping the relevant set of subcooling values associated with one or more time periods into bins based on a plurality of factors, at step 704.

In some examples, the grouping of the data at step 704 may be based on factors such as compressor speed value, outdoor ambient temperature, date, or other factors. In these examples, the process 700 may seek to group the subcooling values into specific categories for a given time period, e.g., a given day. For examples, the process may group the subcooling values associated with a given fixed speed of a compressor and a given outdoor temperature for each day. In these examples, the subcooling values associated with a first outdoor ambient temperature on a given date may be grouped in a first bin on that date. The subcooling values associated with a second outdoor ambient temperature on the same date may be grouped in a second bin for that date, and so on. Further, in some of these examples, the subcooling values grouped in each bin may all relate to a given compressor speed or speed range. For example, a process similar to the compressor speed parameter discussed above may be used. In this way, each subcooling value for a given time period may be comparable based on both outdoor ambient temperatures and compressor speed. Grouping the subcooling values in this way may be beneficial to group the subcooling values based on key variables for subcooling performance, e.g., external load and rate of refrigerant flow/pressure. In some examples other processes are used to group the subcooling values into bins.

To provide a further illustration of this grouping process, FIG. 7B is used. The depicted illustration shows an example of how subcooling values may be grouped and binned. In this example, the y-axis 750 represents subcooling values and the x-axis represents time 752. Further, in this example, the x-axis is broken up into three time periods 754, and each time period has four bins 756 of data. In particular, the time periods are days, and subcooling values are grouped into three days, June 1, July 1, and August 1. Each of these time periods has four bins of subcooling values, which in this example are binned based on outdoor ambient temperature. As shown, the subcooling values are binned in each group for outdoor ambient temperatures of between 63° F.-66° F. The subcooling values are further grouped into additional bins based on outdoor ambient temperature, e.g., temperature ranges of 66° F.-69° F., 69° F.-72° F., and 72° F.-75° F.

In this depicted example, each bin 756 for each time period 754 are plotted next to each other. Further, the data point plotted 758 for each bin/time period combination may be representative of the subcooling values within that bin. In some examples, the data point is the average subcooling value within that bin. Other representative values may also be used. Further, as discussed above, the subcooling values associated with each bin/time period may be based on the outdoor ambient temperature and other factors, e.g., compressor speed, etc.

Returning to the process 700, in some examples, an initial comparison of the binned data is performed at step 706. This initial comparison may be performed to determine whether there is an indication of a refrigerant leak at this point. If no leak is determined then the process may continue.

In some examples, the initial comparison at step 706 may include determining an average subcooling value for each bin/time period of subcooling data. In these examples, the average subcooling values may be used as the representative subcooling metric for this initial test. These averaged subcooling values may be compared to a target subcooling metric as discussed above. For example, the averaged subcooling value for each group of binned data may be compared to determine whether that value is within a threshold range of the target subcooling value, e.g., +/−3° F. In these examples, if this comparison indicates the climate control system has an improper level of charge, then the alert may be provided (or other action) as discussed above. In some of these examples, if this comparison does not indicate an improper level of charge than the process 700 continues to step 708 to determine a different representative subcooling metric and a different target subcooling metric using this process 700.

In some examples, the process 700 may determine a linear slope for each time period at step 708. In these examples, the linear slope for each group may be based on a linear regression of the bins of subcooling values within the time period 756. For example, a linear regression may be performed on subcooling values associated with the bin/time period. In some examples, the linear regression may be performed on representative subcooling values for each bin. Other times of regression analysis and fit patters may also be utilized.

To walk through a further example, reference is again made to FIG. 7B. In this example, the linear slope for a time period, the first time period (June 1), is shown as 760. This linear slope represents the linear regression from the representative subcooling values 758 for the bins of this first time period. In this example, because the representatives subcooling values 758 for the other time periods, e.g., the July 1 and August 1 time periods are the same, the linear slope for all the groups are the same in this example. This example also includes an additional slope line 762 that provides a representation of a slope line that may be determined by a different group, potentially one where the subcooling performance was decreasing.

Returning to the process 700 in FIG. 7A, the linear slopes for these groups may be used to determine the representative subcooling metric at step 710. For example, the representative subcooling metric may be the change in linear slope value between a first time period and the linear slope of a second time period. In some examples, the first time period is separated from the second time period by a minimum length of time, potentially a minimum number of days. Again, using FIG. 7B as an example, the minimum time period may be 1 month. In these examples, the linear slope at each of these time periods may be compared, e.g., the slope on June 1 and the slope on July 1, etc. Other time periods may be used, e.g., 15 days. Again, in the example depicted in FIG. 7B because the representative subcooling values are the same for each group there the representative subcooling metric in this example would be 0. However, if the linear slope in one of the groups was the slope represented by 762 then the representative subcooling metric may be the difference between these slopes. For example, the linear slope for the first time period may be $\theta_1$ and the linear slope for the second time period may be $\theta_2$. In this example, the representative subcooling metric may be the difference between $\theta_1$ and $\theta_2$. Other processes may also be utilized.

The process 700 may compare the representative subcooling value determined at step 710 to a target subcooling metric at step 712 as shown in FIG. 7A. In some examples, the target subcooling metric may be a minimum rate of change. For example, a zero rate of change may indicate that the subcooling performance has not changed during the time period. In some examples, the target subcooling metric may include a tolerance range that indicates normal deviation for the subcooling performance. In these examples, if the change in linear slope determined at step 710 is within the tolerance range than the process may determine that no leak exists, as shown in step 714. If the change in the linear slope is greater than this tolerance range then the process may determine a leak exists, as shown in step 716.

In these examples, if the process 700 determines a leak exists, the process may further determine the rate of the refrigerant leak, at step 718. In these examples, the change in the linear slopes determined at step 710 may provide an indication of rate at which the refrigerant is leaking. For example, this slope may be converted to a rate based on a look-up table or other calculations based on the underlying system. Further, in some examples, this rate of leak is covered to a timing for when the refrigerant charge goes below a given threshold, potentially a critically low level. In these examples, the process may also provide an indication of the rate of the refrigerant leak. This indication may be provided and/or displayed using any of the process discussed herein.

FIG. 8 illustrates the control circuitry 800, which may be the apparatus, according to some example embodiments of the present disclosure. In some examples the control circuit includes some or all of the system controller 106, the indoor controller 124, and the outdoor controller 126. In some examples, the control circuitry may include one or more of each of a number of components such as, for example, a processor 802 connected to a memory 804. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 802 may be a number of processors, a multi-core processor or some other type of processor, depending on the particular embodiment.

The processor 802 may be configured to execute computer programs such as computer-readable program code 806, which may be stored onboard the processor or otherwise stored in the memory 804. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 804 is generally any piece of computer hardware capable of storing information such as, for example, data, computer-readable program code 806 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 802, causes the control circuitry 800 to perform various operations as described herein, some of which may in turn cause the HVAC system to perform various operations.

In addition to the memory 804, the processor 802 may also be connected to one or more peripherals such as a network adapter 808, one or more input/output (I/O) devices 810 or the like. The network adapter is a hardware component configured to connect the control circuitry 800 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A method of monitoring refrigerant charge within a climate control system, the method comprising: monitoring a subcooling performance of the climate control system by determining subcooling values for the climate control system; identifying a relevant set of subcooling values based on a plurality of parameters; determining a representative subcooling metric for the climate control system from the relevant set of subcooling values; comparing the representative subcooling metric to a target subcooling metric; and providing a signal based on the comparison, the signal being indicative of a level of refrigerant charge within the climate control system.

Clause 2. The method in any of the clauses, wherein determining the subcooling values includes receiving temperature measurements and pressure measurements proximate an outdoor heat exchanger of the climate control system.

Clause 3. The method in any of the clauses, wherein determining the subcooling values includes receiving two different temperature measurements proximate an outdoor heat exchanger of the climate control system.

Clause 4. The method in any of the clauses, wherein determining the representative subcooling metric includes determining an average of the relevant set of subcooling values over a time range.

Clause 5. The method in any of the clauses, wherein determining the representative subcooling metric includes determining a time-weighted average of the relevant set of subcooling values over a time range.

Clause 6. The method in any of the clauses, wherein the plurality of parameters includes determining one or more time periods while a compressor of the climate control system is operating above a speed threshold and selecting the subcooling values that correspond to the one or more time periods for the relevant set of subcooling values.

Clause 7. The method in any of the clauses, wherein determining the one or more time periods further includes determining the compressor of the climate control system is operating above the speed threshold and at least one of the following conditions are met: a compressor run time exceeds a minimum run time value, an outdoor ambient temperature is within a target outdoor ambient temperature range, a superheat value for the climate control system is within a target superheat range, and an airflow rate of change for an indoor fan of the climate control system is within a target airflow rate of change range.

Clause 8. The method in any of the clauses, wherein the representative subcooling metric and the target subcooling metric are each a set value, and comparing the representative subcooling metric to the target subcooling metric includes determining if the representative subcooling metric is less than the target subcooling metric.

Clause 9. The method in any of the clauses, wherein the representative subcooling metric is a set value, and the target subcooling metric includes a minimum subcooling value and a maximum subcooling value, and comparing the representative subcooling metric to the target subcooling metric includes determining if the representative subcooling metric is between the minimum subcooling value and the maximum subcooling value.

Clause 10. The method in any of the clauses, wherein determining the representative subcooling metric includes determining a representative subcooling trend for the climate control system, and the target subcooling metric includes a target subcooling trend, and wherein comparing the representative subcooling metric to the target subcooling metric includes comparing the representative subcooling trend to the target subcooling trend.

Clause 11. The method in any of the clauses, wherein determining the representative subcooling trend for the climate control system further includes filtering the relevant set of subcooling values and preforming a regression analysis on the filtered relevant set of subcooling values, wherein the filtering includes at least one of the following: applying a time window, smoothing the relevant set of subcooling values, validating the relevant set of subcooling values, confirming a minimum number of values are included in the relevant set of subcooling values, and confirming a minimum time span between an initial subcooling value and a last subcooling value in the relevant set of subcooling values.

Clause 12. The method in any of the clauses, wherein the regression analysis includes a linear regression that determines a linear trend line and a confidence interval, the confidence interval providing a range for the linear trend line.

Clause 13. The method in any of the clauses, wherein the target subcooling trend includes an upper trend limit and a lower trend limit, and wherein comparing the representative subcooling value to the target subcooling value includes determining whether the representative subcooling trend is between the upper trend limit and the lower trend limit.

Clause 14. The method in any of the clauses, wherein the representative subcooling trend for the climate control system includes a linear trend line and a confidence interval, the confidence interval providing a range for the linear trend line, wherein the target subcooling trend includes an upper trend limit and a lower trend limit, and wherein comparing the representative subcooling metric to the target subcooling metric includes determining whether the range for the linear trend line overlaps at least one of the upper trend limit and the lower trend limit.

Clause 15. The method in any of the clauses, further comprising determining the target subcooling metric based on a simulation model, the simulation model being derived from a plurality of inputs.

Clause 16. The method in any of the clauses, wherein the simulation model is further derived from the plurality of inputs and testing information.

Clause 17. The method in any of the clauses, further comprising: grouping the relevant set of subcooling values associated with one or more time period into bins based on a plurality of factors, each time period including one or more bins of subcooling values, and wherein the plurality of factors include a compressor fixed speed value and an outdoor ambient temperature; determining a linear slope for each time period, the linear slope for each time period being based on a linear regression of the bins of subcooling values within the time period; and wherein determining the representative subcooling metric includes determining a change in linear slope value by comparing the linear slope of a first time period to the linear slope of a second time period, wherein comparing the representative subcooling metric to the target subcooling metric includes comparing the change in linear slope to a target linear slope change.

Clause 18. The method in any of the clauses, wherein the first time period is separated from the second time period by a minimum time range.

Clause 19. The method in any of the clauses, further comprising providing an additional signal indicative of a rate of refrigerant leak based on the comparison.

Clause 20. An apparatus for monitoring a climate control system, the apparatus comprising: a memory configured to store computer-readable program code including a monitoring-related software application; and a processor configured to access the memory, and execute the computer-readable program code including the monitoring-related software application to cause the apparatus to at least: monitor a subcooling performance of the climate control system by determining subcooling values for the climate control system, identify a relevant set of subcooling values based on a plurality of parameters, determine a representative subcooling metric for the climate control system from the relevant set of subcooling values, compare the representative subcooling metric to a target subcooling metric, and provide a signal based on the comparison, the signal being indicative of a level of refrigerant charge within the climate control system.

Clause 21. The apparatus in any of the clauses, wherein the processor configured to access the memory, and execute the computer-readable program code to cause the apparatus to determine the subcooling values is further configured to receive temperature measurements and pressure measurements proximate an outdoor heat exchanger of the climate control system.

Clause 22. The apparatus in any of the clauses, wherein the processor configured to access the memory, and execute the computer-readable program code to cause the apparatus to determine the subcooling values is further configured to receive two different temperature measurements proximate an outdoor heat exchanger of the climate control system.

Clause 23. The apparatus in any of the clauses, wherein the processor configured to access the memory, and execute the computer-readable program code to cause the apparatus to determine the representative subcooling metric is further configured to determine an average of the relevant set of subcooling values over a time range.

Clause 24. The apparatus in any of the clauses, wherein the processor configured to access the memory, and execute the computer-readable program code to cause the apparatus to determine the representative subcooling metric is further configured to determine a time-weighted average of the relevant set of subcooling values over a time range.

Clause 25. The apparatus in any of the clauses, wherein the plurality of parameters includes determining one or more time periods while a compressor of the climate control system is operating above a speed threshold and selecting the subcooling values that correspond to the one or more time periods for the relevant set of subcooling values.

Clause 26. The apparatus in any of the clauses, wherein determining the one or more time periods further includes determining the compressor of the climate control system is operating above the speed threshold and at least one of the following conditions are met: a compressor run time exceeds a minimum run time value, an outdoor ambient temperature is within a target outdoor ambient temperature range, a superheat value for the climate control system is within a target superheat range, and an airflow rate of change for an indoor fan of the climate control system is within a target airflow rate of change range.

Clause 27. The apparatus in any of the clauses, wherein the representative subcooling metric and the target subcooling metric are each a set value, and wherein the processor configured to access the memory, and execute the computer-readable program code to cause the apparatus to compare the representative subcooling metric to the target subcooling metric is further configured to determine if the representative subcooling metric is less than the target subcooling metric.

Clause 28. The apparatus in any of the clauses, wherein the representative subcooling metric is a set value, and the target subcooling metric includes a minimum subcooling value and a maximum subcooling value, and wherein the processor configured to access the memory, and execute the computer-readable program code to cause the apparatus to compare the representative subcooling metric to the target subcooling metric is further configured to determine if the representative subcooling metric is between the minimum subcooling value and the maximum subcooling value.

Clause 29. The apparatus in any of the clauses, wherein the processor configured to access the memory, and execute the computer-readable program code to cause the apparatus to determine the representative subcooling metric is further configured to determine a representative subcooling trend for the climate control system, and the target subcooling metric includes a target subcooling trend, and wherein the processor configured to access the memory, and execute the computer-readable program code to cause the apparatus to compare the representative subcooling metric to the target subcooling metric is further configured to compare the representative subcooling trend to the target subcooling trend.

Clause 30. The apparatus in any of the clauses, wherein the processor configured to access the memory, and execute the computer-readable program code to cause the apparatus to determine the representative subcooling metric is further configured to filter the relevant set of subcooling values and preforming a regression analysis on the filtered relevant set of subcooling values, wherein the filtering includes at least one of the following: applying a time window, smoothing the relevant set of subcooling values, validating the relevant set of subcooling values, confirming a minimum number of values are included in the relevant set of subcooling values, and confirming a minimum time span between an initial subcooling value and a last subcooling value in the relevant set of subcooling values.

Clause 31. The apparatus in any of the clauses, wherein the regression analysis includes a linear regression that determines a linear trend line and a confidence interval, the confidence interval providing a range for the linear trend line.

Clause 32. The apparatus in any of the clauses, wherein the target subcooling trend includes an upper trend limit and a lower trend limit, and wherein comparing the representative subcooling value to the target subcooling value includes determining whether the representative subcooling trend is between the upper trend limit and the lower trend limit.

Clause 33. The apparatus in any of the clauses, wherein the representative subcooling trend for the climate control system includes a linear trend line and a confidence interval, the confidence interval providing a range for the linear trend line, wherein the target subcooling trend rate includes an upper trend rate limit and a lower trend rate limit, and wherein comparing the representative subcooling metric to the target subcooling metric includes determining whether the range for the linear trend line overlaps at least one of the upper trend rate limit and the lower trend rate limit.

Clause 34. The apparatus in any of the clauses, wherein the processor configured to access the memory, and execute the computer-readable program code to cause the apparatus to determine the representative subcooling metric is further configured to determine the target subcooling metric based on a simulation model, the simulation model being derived from a plurality of inputs.

Clause 35. The apparatus in any of the clauses, wherein the simulation model is further derived from the plurality of inputs and testing information.

Clause 36. The apparatus in any of the clauses, wherein the processor configured to access the memory, and execute the computer-readable program code including the monitoring-related software application further causes the apparatus to at least: grouping the relevant set of subcooling values associated with one or more time period into bins based on a plurality of factors, each time period including one or more bins of subcooling values, and wherein the plurality of factors include a compressor fixed speed value and an outdoor ambient temperature; determining a linear slope for each time period, the linear slope for each time period being based on a linear regression of the bins of subcooling values within the time period; and wherein the processor configured to access the memory, and execute the computer-readable program code to cause the apparatus to determine the representative subcooling metric is further configured determine a change in linear slope value by comparing the linear slope of a first time period to the linear slope of a second time period, wherein the processor configured to access the memory, and execute the computer-readable program code to cause the apparatus to compare the representative subcooling metric to the target subcooling metric is further configured to compare the change in linear slope to a target linear slope change.

Clause 37. The apparatus in any of the clauses, wherein the first time period is separated from the second time period by a minimum time range.

Clause 38. The apparatus in any of the clauses, wherein the processor configured to access the memory, and execute the computer-readable program code including the monitoring-related software application further causes the apparatus to at least: provide an additional signal indicative of a rate of refrigerant leak based on the comparison.

Many modifications and other embodiments of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments disclosed and that modifications and other embodiments are intended to be included within the scope of the appended claims. Moreover, although the foregoing description and the associated figures describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method of monitoring refrigerant charge within a climate control system, the method comprising:

monitoring a subcooling performance of the climate control system by determining subcooling values for the climate control system, wherein determining the subcooling values includes:

receiving data indicative of a refrigerant pressure and a refrigerant temperature from at least one pressure sensor and at least one temperature sensor disposed proximate an outdoor heat exchanger of the climate control system;

identifying a relevant set of subcooling values based on a plurality of parameters;

determining a representative subcooling metric for the climate control system from the relevant set of subcooling values, the determining the representative subcooling metric including determining a representative subcooling trend for the climate control system;

comparing the representative subcooling metric to a target subcooling metric that includes a target subcooling trend, wherein the comparing includes comparing the representative subcooling trend to the target subcooling trend; and providing a signal based on the comparison, the signal being indicative of a level of refrigerant charge within the climate control system being acceptable or improper to indicate whether a refrigerant leak has occurred in the climate control system.

2. The method of claim 1, wherein the pressure sensor and the temperature sensor are located on a refrigerant circuit of the climate control system downstream from the outdoor heat exchanger when the climate control system is in a cooling mode.

3. The method of claim 1, wherein determining the subcooling values includes receiving two different temperature measurements proximate the outdoor heat exchanger of the climate control system.

4. The method of claim 1, wherein determining the representative subcooling metric includes determining an average of the relevant set of subcooling values over a time range.

5. The method of claim 1, wherein determining the representative subcooling metric includes determining a time-weighted average of the relevant set of subcooling values over a time range.

6. The method of claim 1, wherein the plurality of parameters includes determining one or more time periods while a compressor of the climate control system is operating above a speed threshold and selecting the subcooling values that correspond to the one or more time periods for the relevant set of subcooling values.

7. The method of claim 6, wherein determining the one or more time periods further includes determining the compressor of the climate control system is operating above the speed threshold and at least one of the following conditions are met:

a compressor run time exceeds a minimum run time value, an outdoor ambient temperature is within a target outdoor ambient temperature range, a superheat value for the climate control system is within a target superheat range, and an airflow rate of change for an indoor fan of the climate control system is within a target airflow rate of change range.

8. The method of claim 1, wherein the representative subcooling metric and the target subcooling metric are each a set value, and comparing the representative subcooling metric to the target subcooling metric includes determining if the representative subcooling metric is less than the target subcooling metric.

9. The method of claim 1, wherein the representative subcooling metric is a set value, and the target subcooling metric includes a minimum subcooling value and a maximum subcooling value, and comparing the representative subcooling metric to the target subcooling metric includes determining if the representative subcooling metric is between the minimum subcooling value and the maximum subcooling value.

10. The method of claim 1, wherein determining the representative subcooling trend for the climate control system further includes filtering the relevant set of subcooling values and preforming a regression analysis on the filtered relevant set of subcooling values, wherein the filtering includes at least one of the following:

applying a time window, smoothing the relevant set of subcooling values, validating the relevant set of subcooling values, confirming a minimum number of values are included in the relevant set of subcooling values, and confirming a minimum time span between an initial subcooling value and a last subcooling value in the relevant set of subcooling values.

11. The method of claim 10, wherein the regression analysis includes a linear regression that determines a linear trend line and a confidence interval, the confidence interval providing a range for the linear trend line.

12. The method of claim 1, wherein the target subcooling trend includes an upper trend limit and a lower trend limit, and wherein comparing the representative subcooling value to the target subcooling value includes determining whether the representative subcooling trend is between the upper trend limit and the lower trend limit.

13. The method of claim 1, wherein the representative subcooling trend for the climate control system includes a linear trend line and a confidence interval, the confidence interval providing a range for the linear trend line, wherein the target subcooling trend includes an upper trend limit and a lower trend limit, and wherein comparing the representative subcooling metric to the target subcooling metric includes determining whether the range for the linear trend line overlaps at least one of the upper trend limit and the lower trend limit.

14. The method of claim 1, further comprising determining the target subcooling metric based on a simulation model, the simulation model being derived from a plurality of inputs.

15. The method of claim 14, wherein the simulation model is further derived from the plurality of inputs and testing information.

16. The method of claim 1, further comprising:

grouping the relevant set of subcooling values associated with one or more time period into bins based on a plurality of factors, each time period including one or more bins of subcooling values, and wherein the plurality of factors include a compressor fixed speed value and an outdoor ambient temperature;

determining a linear slope for each time period, the linear slope for each time period being based on a linear regression of the bins of subcooling values within the time period; and wherein determining the representative subcooling metric includes determining a change in linear slope value by comparing the linear slope of a first time period to the linear slope of a second time period, wherein comparing the representative subcooling metric to the target subcooling metric includes comparing the change in linear slope to a target linear slope change.

17. The method of claim 16, wherein the first time period is separated from the second time period by a minimum time range.

18. The method of claim 16, further comprising providing an additional signal indicative of a rate of refrigerant leak based on the comparison.

19. An apparatus for monitoring a climate control system, the apparatus comprising:

a memory configured to store computer-readable program code including a monitoring-related software application; and a processor configured to access the memory, and execute the computer-readable program code including the monitoring-related software application to cause the apparatus to at least:

monitor a subcooling performance of the climate control system by determining subcooling values for the climate control system, wherein determining the subcooling values includes:

receiving data indicative of a refrigerant pressure and a refrigerant temperature from at least one pressure sensor and at least one temperature sensor disposed proximate an outdoor heat exchanger of the climate control system, identify a relevant set of subcooling values based on a plurality of parameters, determine a representative subcooling metric for the climate control system from the relevant set of subcooling values including determining a representative subcooling trend for the climate control system, compare the representative subcooling metric to a target subcooling metric that includes a target subcooling trend, wherein the comparing includes comparing the representative subcooling trend to the target subcooling trend, and provide a signal based on the comparison, the signal being indicative of a level of refrigerant charge within the climate control system being acceptable or improper to indicate whether a refrigerant leak has occurred in the climate control system.

20. The apparatus of claim 19, wherein the pressure sensor and the temperature sensor are located on a refrigerant circuit of the climate control system downstream from the outdoor heat exchanger when the climate control system is in a cooling mode.

21. The apparatus of claim 19, wherein the processor configured to access the memory, and execute the computer-readable program code to cause the apparatus to determine the subcooling values is further configured to receive two different temperature measurements proximate the outdoor heat exchanger of the climate control system.

22. The apparatus of claim 19, wherein the processor configured to access the memory, and execute the computer-readable program code to cause the apparatus to determine the representative subcooling metric is further configured to determine an average of the relevant set of subcooling values over a time range.

23. The apparatus of claim 19, wherein the processor configured to access the memory, and execute the computer-readable program code to cause the apparatus to determine the representative subcooling metric is further configured to determine a time-weighted average of the relevant set of subcooling values over a time range.

24. The apparatus of claim 19, wherein the plurality of parameters includes determining one or more time periods while a compressor of the climate control system is operating above a speed threshold and selecting the subcooling values that correspond to the one or more time periods for the relevant set of subcooling values.

25. The apparatus of claim 24, wherein determining the one or more time periods further includes determining the compressor of the climate control system is operating above the speed threshold and at least one of the following conditions are met:

a compressor run time exceeds a minimum run time value, an outdoor ambient temperature is within a target outdoor ambient temperature range, a superheat value for the climate control system is within a target superheat range, and an airflow rate of change for an indoor fan of the climate control system is within a target airflow rate of change range.

26. The apparatus of claim 19, wherein the representative subcooling metric and the target subcooling metric are each a set value, and wherein the processor configured to access the memory, and execute the computer-readable program code to cause the apparatus to compare the representative subcooling metric to the target subcooling metric is further configured to determine if the representative subcooling metric is less than the target subcooling metric.

27. The apparatus of claim 19, wherein the representative subcooling metric is a set value, and the target subcooling metric includes a minimum subcooling value and a maximum subcooling value, and wherein the processor configured to access the memory, and execute the computer-readable program code to cause the apparatus to compare the representative subcooling metric to the target subcooling metric is further configured to determine if the representative subcooling metric is between the minimum subcooling value and the maximum subcooling value.

28. The apparatus of claim 19, wherein the processor configured to access the memory, and execute the computer-readable program code to cause the apparatus to determine the representative subcooling metric is further configured to filter the relevant set of subcooling values and preforming a regression analysis on the filtered relevant set of subcooling values, wherein the filtering includes at least one of the following:

applying a time window, smoothing the relevant set of subcooling values, validating the relevant set of subcooling values, confirming a minimum number of values are included in the relevant set of subcooling values, and confirming a minimum time span between an initial subcooling value and a last subcooling value in the relevant set of subcooling values.

29. The apparatus of claim 28, wherein the regression analysis includes a linear regression that determines a linear trend line and a confidence interval, the confidence interval providing a range for the linear trend line.

30. The apparatus of claim 28, wherein the processor configured to access the memory, and execute the computer-readable program code including the monitoring-related software application further causes the apparatus to at least:

grouping the relevant set of subcooling values associated with one or more time period into bins based on a plurality of factors, each time period including one or more bins of subcooling values, and wherein the plurality of factors include a compressor fixed speed value and an outdoor ambient temperature;

determining a linear slope for each time period, the linear slope for each time period being based on a linear regression of the bins of subcooling values within the time period; and wherein the processor configured to access the memory, and execute the computer-readable program code to cause the apparatus to determine the representative subcooling metric is further configured determine a change in linear slope value by comparing the linear slope of a first time period to the linear slope of a second time period, wherein the processor configured to access the memory, and execute the computer-readable program code to cause the apparatus to compare the representative subcooling metric to the target subcooling metric is further configured to compare the change in linear slope to a target linear slope change.

31. The apparatus of claim 30, wherein the first time period is separated from the second time period by a minimum time range.

32. The apparatus of claim 30, wherein the processor configured to access the memory, and execute the computer-readable program code including the monitoring-related software application further causes the apparatus to at least:

provide an additional signal indicative of a rate of refrigerant leak based on the comparison.

33. The apparatus of claim 19, wherein the target subcooling trend includes an upper trend limit and a lower trend limit, and wherein comparing the representative subcooling value to the target subcooling value includes determining whether the representative subcooling trend is between the upper trend limit and the lower trend limit.

34. The apparatus of claim 19, wherein the representative subcooling trend for the climate control system includes a linear trend line and a confidence interval, the confidence interval providing a range for the linear trend line, wherein the target subcooling trend rate includes an upper trend rate limit and a lower trend rate limit, and wherein comparing the representative subcooling metric to the target subcooling metric includes determining whether the range for the linear trend line overlaps at least one of the upper trend rate limit and the lower trend rate limit.

35. The apparatus of claim 19, wherein the processor configured to access the memory, and execute the computer-readable program code to cause the apparatus to determine the representative subcooling metric is further configured to determine the target subcooling metric based on a simulation model, the simulation model being derived from a plurality of inputs.

36. The apparatus of claim 35, wherein the simulation model is further derived from the plurality of inputs and testing information.

* * * * *